US010065414B2

(12) United States Patent
Nishiyama et al.

(10) Patent No.: US 10,065,414 B2
(45) Date of Patent: Sep. 4, 2018

(54) INKJET PRINTING APPARATUS WITH WIPER FOR INKJET HEAD

(71) Applicant: RISO KAGAKU CORPORATION, Tokyo (JP)

(72) Inventors: Akira Nishiyama, Ibaraki (JP); Shunta Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/492,489

(22) Filed: Apr. 20, 2017

(65) Prior Publication Data

US 2017/0341374 A1 Nov. 30, 2017

(30) Foreign Application Priority Data

May 27, 2016 (JP) ..... 2016-106454

(51) Int. Cl.
*B41J 2/165* (2006.01)
*B41J 2/045* (2006.01)
(Continued)

(52) U.S. Cl.
CPC ..... *B41J 2/04508* (2013.01); *B41J 2/04586* (2013.01); *B41J 2/16505* (2013.01); *B41J 2/16535* (2013.01); *B41J 2/16538* (2013.01); *B41J 2/16547* (2013.01); *B41J 2/16585* (2013.01); *B41J 19/00* (2013.01); *B41J 29/02* (2013.01); *B41J 29/13* (2013.01);
(Continued)

(58) Field of Classification Search
CPC ..... B41J 2/04508; B41J 2/04586; B41J 2/16535; B41J 2/16505; B41J 2/16538; B41J 2/16547; B41J 2/16585
See application file for complete search history.

(56) References Cited

U.S. PATENT DOCUMENTS 5,883,648 A 3/1999 Hetzer
9,227,412 B1 1/2016 Liu et al.
(Continued)

FOREIGN PATENT DOCUMENTS

JP 2003-165205 6/2003
JP 2009-056707 3/2009

OTHER PUBLICATIONS

Extended European Search Report for EP 17170591.6 dated Oct. 19, 2017.
(Continued)

*Primary Examiner* — Jason Uhlenhake
(74) *Attorney, Agent, or Firm* — Greenblum & Bernstein, P.L.C.

(57) ABSTRACT

An inkjet printing apparatus includes: a print bar unit having a print bar, a maintainer, and a movement driver; and a controller. Upon maintenance of an inkjet head of the print bar, the controller is configured to drive the movement driver to move the maintainer from a deployment position to a retreat position with the print bar arranged at a maintenance position above a height position for printing while wiping a nozzle surface of the inkjet head with the wiper of the maintainer being moved. The deployment position is a position under the inkjet head in maintenance of the inkjet head and the retreat position is a position where the maintainer is retreated from the deployment position.

7 Claims, 16 Drawing Sheets

(51) Int. Cl.

| | |
|---|---|
| ***B41J 19/00*** | (2006.01) |
| ***B41J 29/02*** | (2006.01) |
| ***B41J 29/13*** | (2006.01) |
| ***B41J 29/15*** | (2006.01) |
| ***B41J 29/377*** | (2006.01) |
| ***B41J 29/38*** | (2006.01) |

(52) U.S. Cl.
CPC ..... *B41J 29/15* (2013.01); *B41J 29/377* (2013.01); *B41J 29/38* (2013.01)

(56) References Cited

U.S. PATENT DOCUMENTS

| | | | | |
|---|---|---|---|---|
| 2004/0246322 | A1 | 12/2004 | Sugaya et al. | |
| 2009/0122107 | A1* | 5/2009 | Ray ..... | B41J 2/16547 347/37 |
| 2013/0293633 | A1 | 11/2013 | Li et al. | |

OTHER PUBLICATIONS

Official communication in EP Application No. 17 170 591.6 dated Jun. 12, 2018.

* cited by examiner

INKJET PRINTING APPARATUS WITH WIPER FOR INKJET HEAD

CROSS REFERENCE TO RELATED APPLICATION

This application is based upon and claims the benefit of priority from the prior Japanese Patent Application No. 2016-106454, filed on May 27, 2016, the entire contents of which are incorporated herein by reference.

BACKGROUND

1. Technical Field

The disclosure relates to an inkjet printing apparatus which performs printing by ejecting an ink from an inkjet head.

2. Related Art

In an inkjet printing apparatus described in Japanese Unexamined Patent Application Publication No. 2003-165205, maintenance of inkjet heads is performed to reduce failure of ink ejection from the inkjet heads.

Among operations performed in the maintenance of the inkjet heads, there is a series of operations including: performing so-called purging to forcedly discharge the ink from nozzles of the inkjet head; and then wiping nozzle surfaces with a wiper. Dust and the like on the nozzle surfaces are thereby removed by the wiper together with the ink discharged from the nozzles and attached to the nozzle surfaces.

A maintainer which performs such maintenance includes an ink receiver, a wiper, and a wiper drive mechanism. The ink receiver receives the ink discharged from the inkjet head in the purging and the ink and the like removed from the nozzle surfaces in the wiping. The wiper wipes the nozzle surfaces while moving. The wiper drive mechanism is a mechanism for moving the wiper.

Among inkjet printing apparatuses, there is an inkjet printing apparatus having multiple print bar units which can be individually pulled out from a housing of the apparatus and which are each provided with an inkjet head. In such an inkjet printing apparatus, work such as replacement work of the inkjet heads can be performed by pulling out the print bar units.

SUMMARY

The aforementioned print bar units may be each provided with the maintainer which performs the maintenance described above. In this case, a lifting-lowering driver provided in each print bar unit moves the inkjet head up above the position for printing. Next, the maintainer is set below the inkjet head. Then, the maintainer wipes the nozzle surfaces by moving the wiper with the wiper drive mechanism.

Providing the maintainer for each print bar unit as described above can reduce the size of the apparatus, compared to the case where, for example, a large maintainer common to all the inkjet heads is provided outside the print bar units. However, it is desirable to further suppress a size increase of the apparatus.

An object of the disclosure is to provide an inkjet printing apparatus capable of suppressing a size increase of the apparatus.

An inkjet printing apparatus in accordance with some embodiments includes: a print bar unit movable in a direction intersecting a conveyance direction of a print medium;

and a controller configured to control the print bar unit. The print bar unit includes: a print bar being liftable and lowerable and having an inkjet head configured to eject an ink to the print medium being conveyed; a maintainer having an ink receiver configured to receive the ink from the inkjet head and a wiper fixed to the ink receiver; and a movement driver configured to move the maintainer between a deployment position and a retreat position, the deployment position being a position under the inkjet head in maintenance of the inkjet head, the retreat position being a position where the maintainer is retreated from the deployment position. Upon maintenance of the inkjet head, the controller is configured to drive the movement driver to move the maintainer from the deployment position to the retreat position with the print bar arranged at a maintenance position above a height position for printing while wiping a nozzle surface of the inkjet head with the wiper of the maintainer being moved.

In the configuration described above, a mechanism and a drive source for moving the wiper in the maintainer can be omitted. Accordingly, the size increase of the apparatus can be suppressed.

The print bar unit may further include a print bar positioner, a state of the print bar positioner being switchable between a deployment state in which the print bar positioner exists at least partially on a lifting-lowering trajectory of the print bar and a retreat state in which the print bar positioner is retreated from the lifting-lowering trajectory of the print bar. The controller may be configured to control the print bar unit such that the print bar positioner is in the retreat state upon the print bar being lifted and lowered between the maintenance position and the height position for printing and such that the print bar positioner is in the deployment state upon the print bar being arranged at the maintenance position and upon the print bar being arranged at the height position for printing. The print bar positioner in the deployment state with the print bar arranged at the maintenance position may support the print bar and position a height position of the print bar. The print bar positioner in the deployment state with the print bar arranged at the height position for printing may form a part of a flow path for cooling air supplied to the ink jet head.

In the configuration described above, the print bar positioner also functions as part of the flow path of the cooling air, and this can further suppress the size increase of the apparatus.

DETAILED DESCRIPTION

Figure 1:
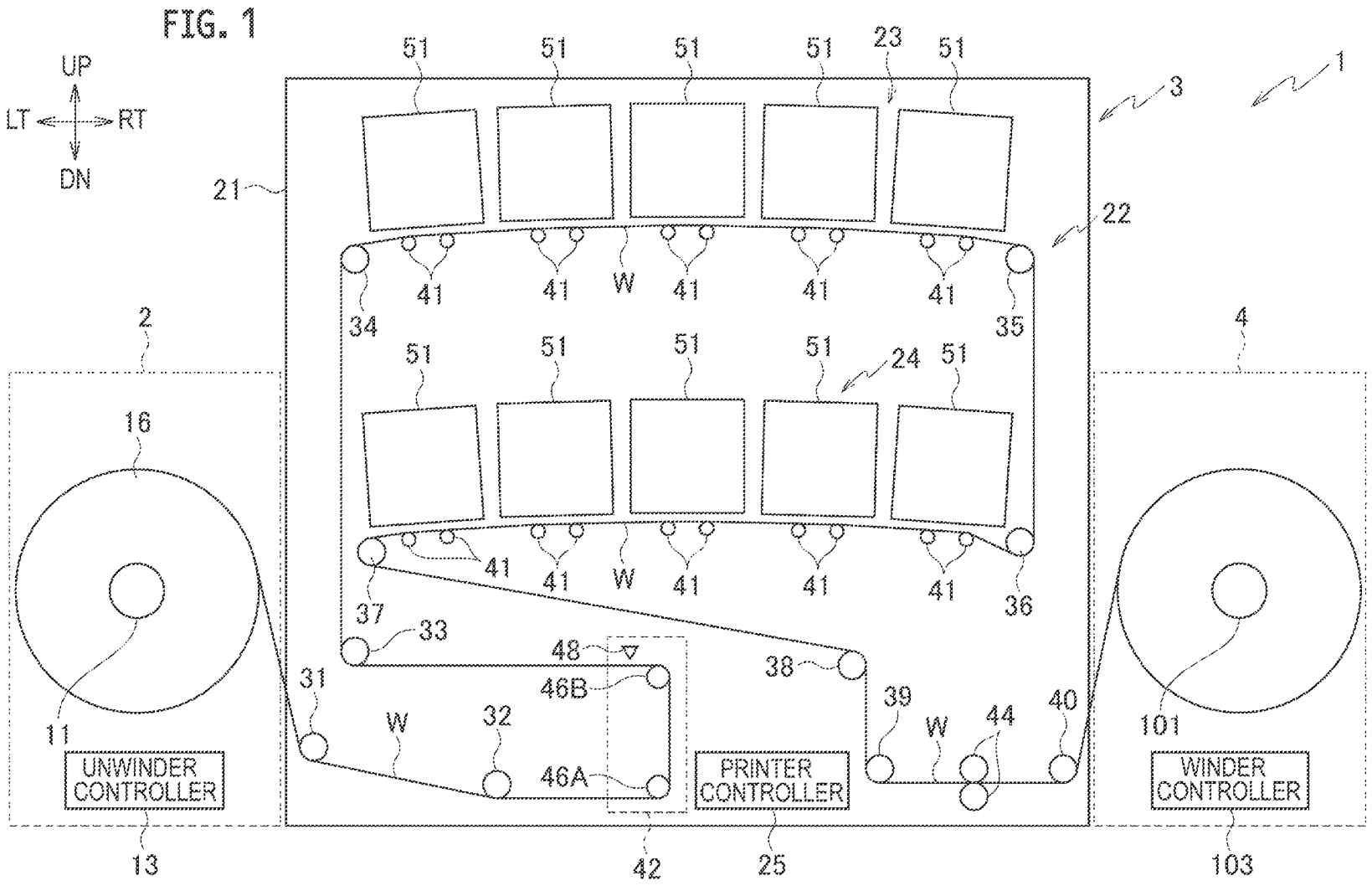
FIG. 1 is a schematic configuration diagram of a printing system including an inkjet printing apparatus in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
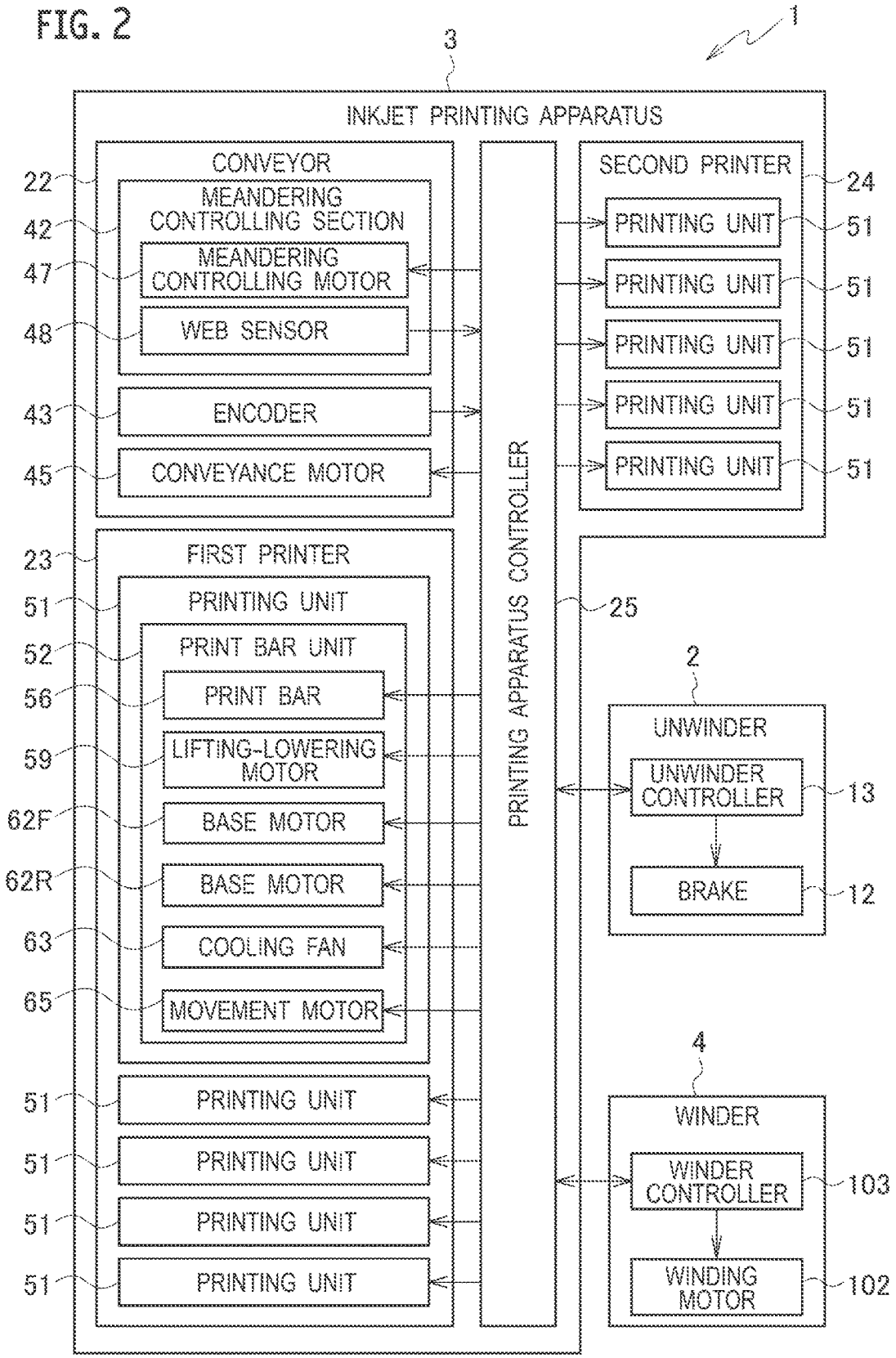
FIG. 2 is a control block diagram of the printing system illustrated in FIG. 1.
Figure 3:
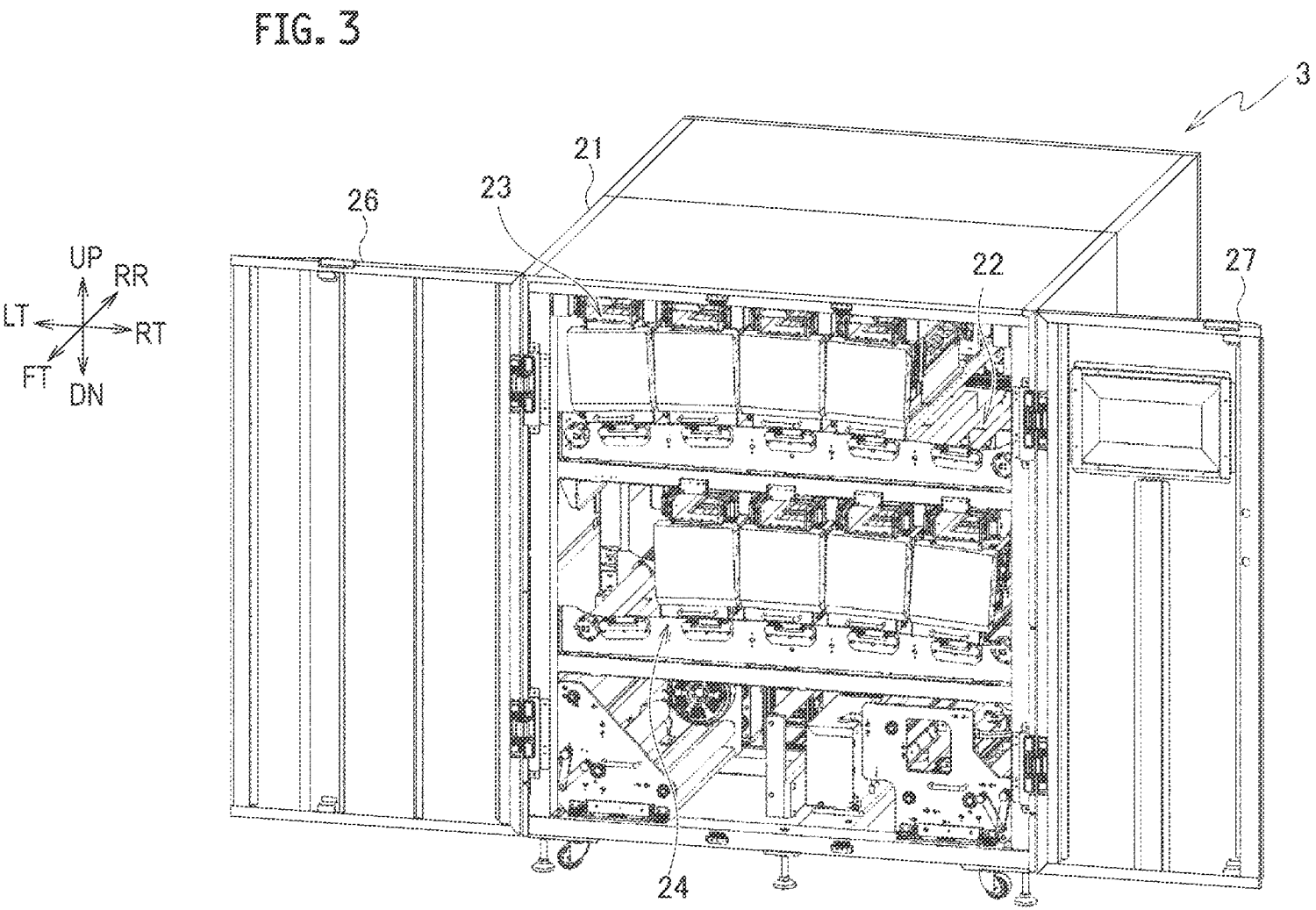
FIG. 3 is a perspective view of the inkjet printing apparatus of the printing system illustrated in FIG. 1.
Figure 4:
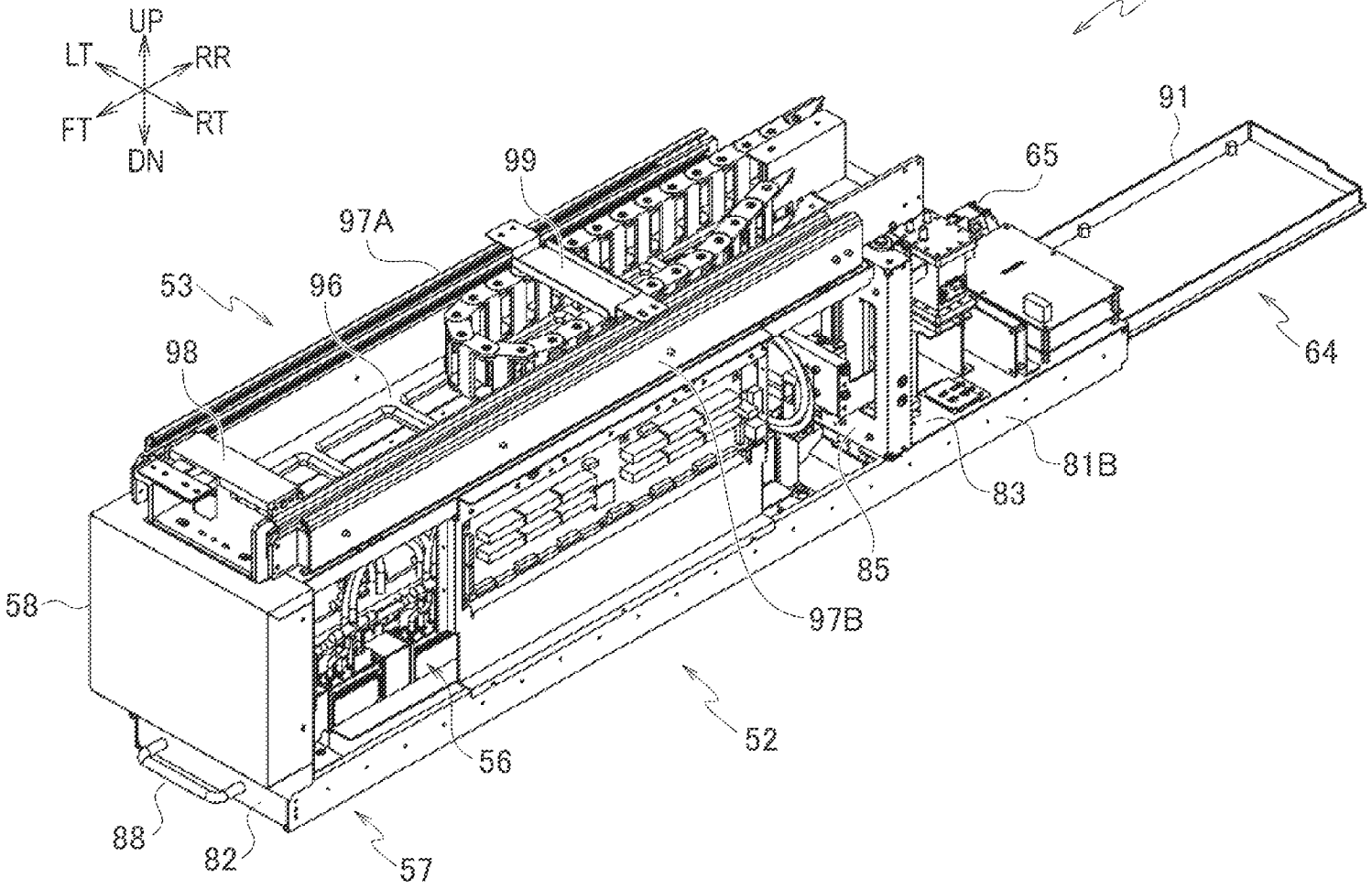
FIG. 4 is a perspective view of a printing unit.
Figure 5:
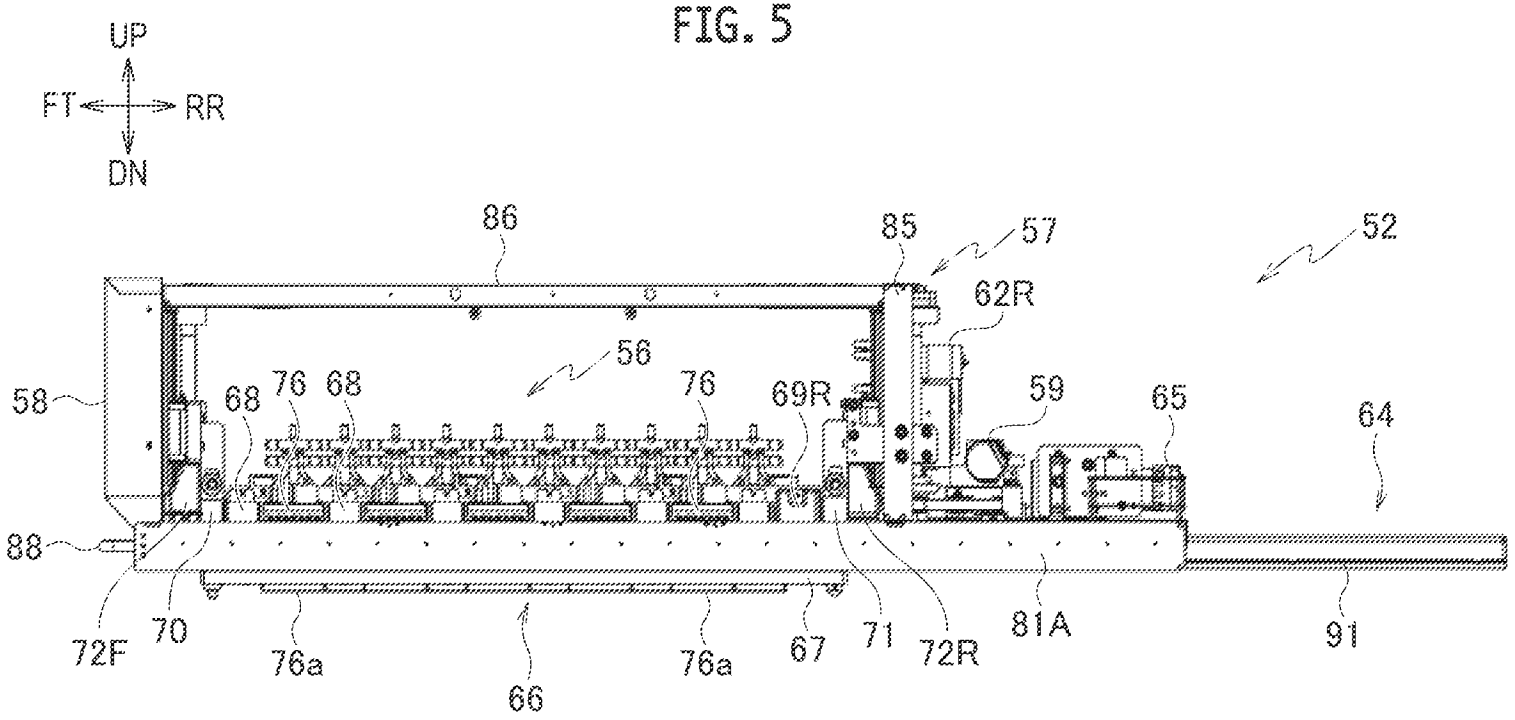
FIG. 5 is a side view of a print bar unit.
Figure 6A:
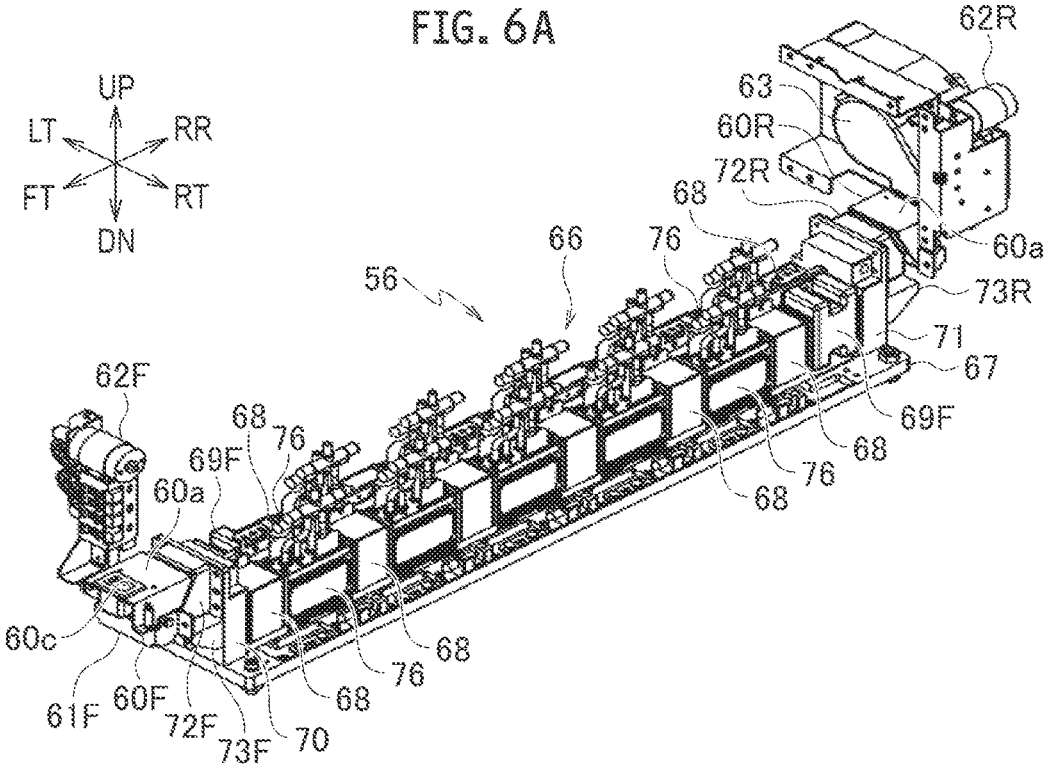
FIG. 6A is a perspective view of a print bar and its periphery.
Figure 6B:
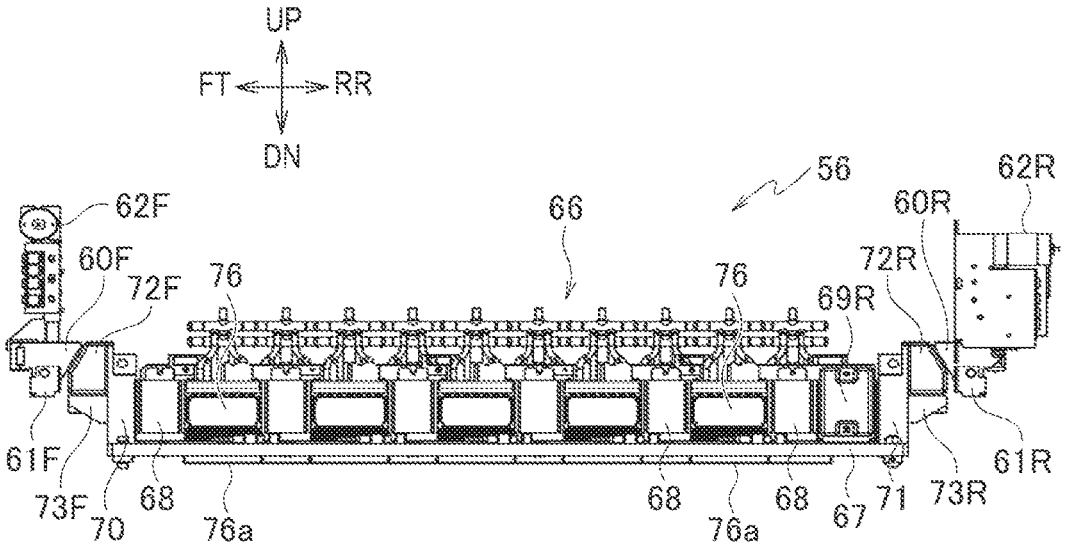
FIG. 6B is a side view of the print bar and its periphery.
Figure 7:
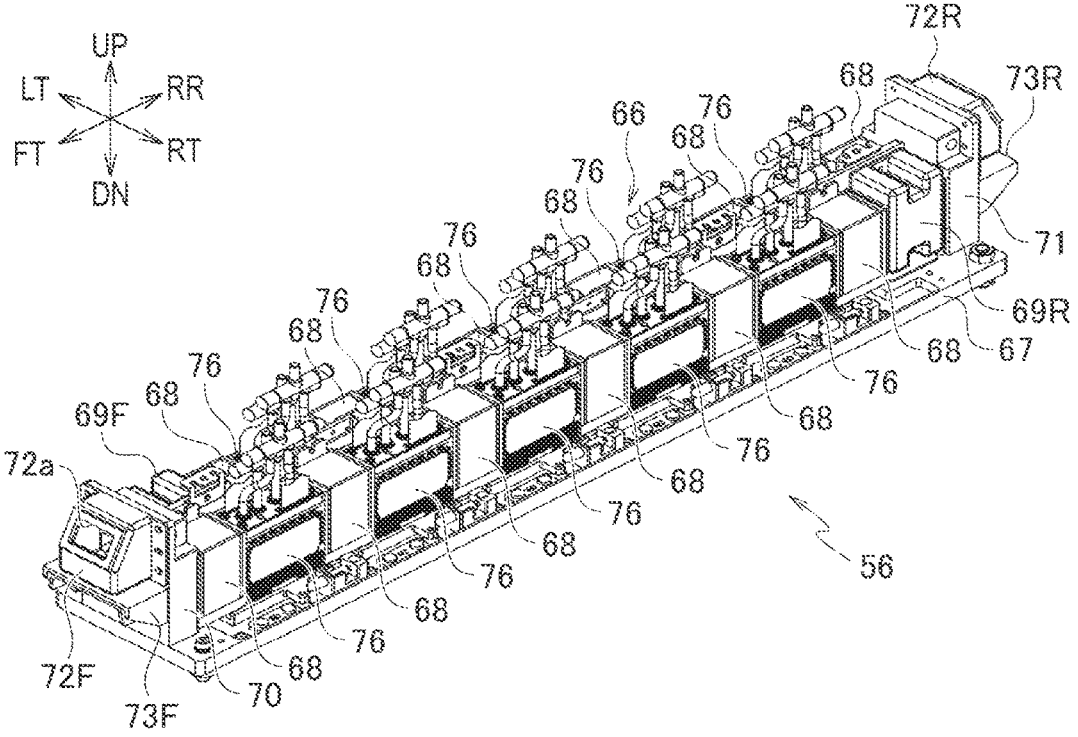
FIG. 7 is a perspective view of the print bar.
Figure 8A:
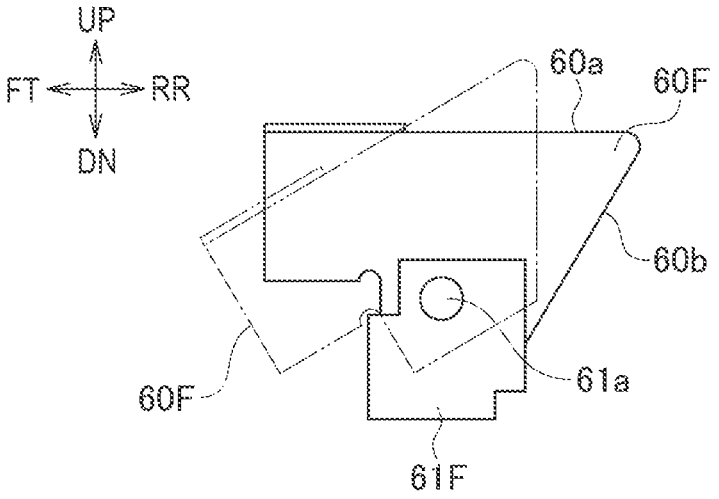
FIG. 8A is a partially enlarged view illustrating print bar bases and print bar base supports.
Figure 8B:
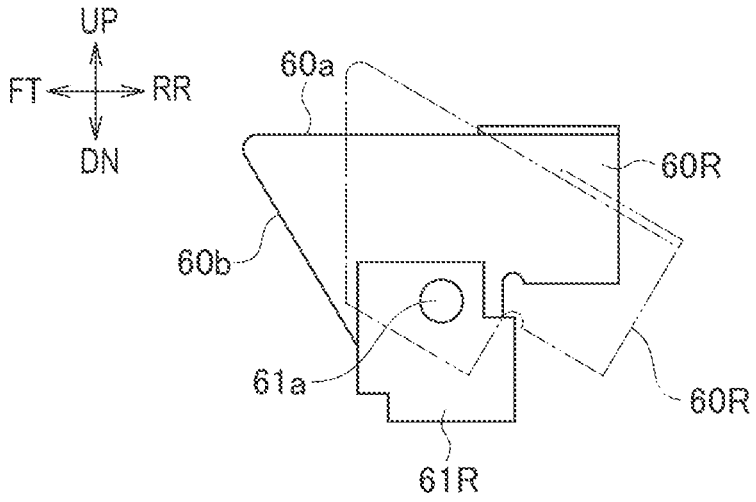
FIG. 8B is a partially enlarged view illustrating the print bar bases and the print bar base supports.
Figure 9:
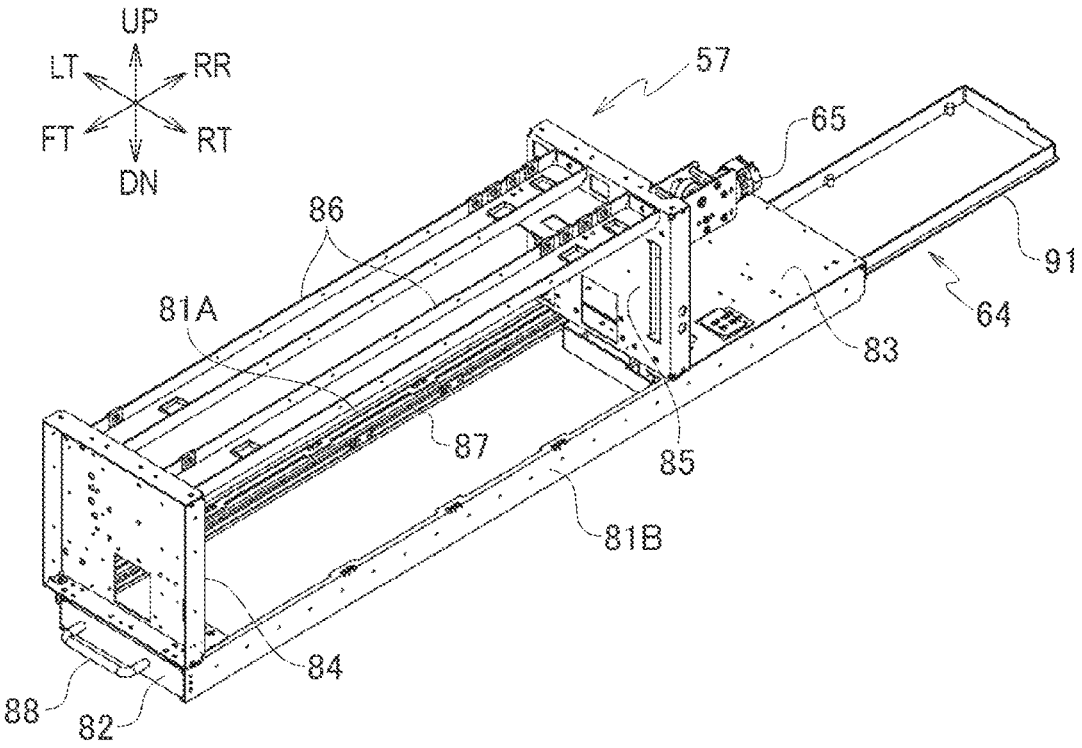
FIG. 9 is a perspective view of a print bar frame.
Figure 10:
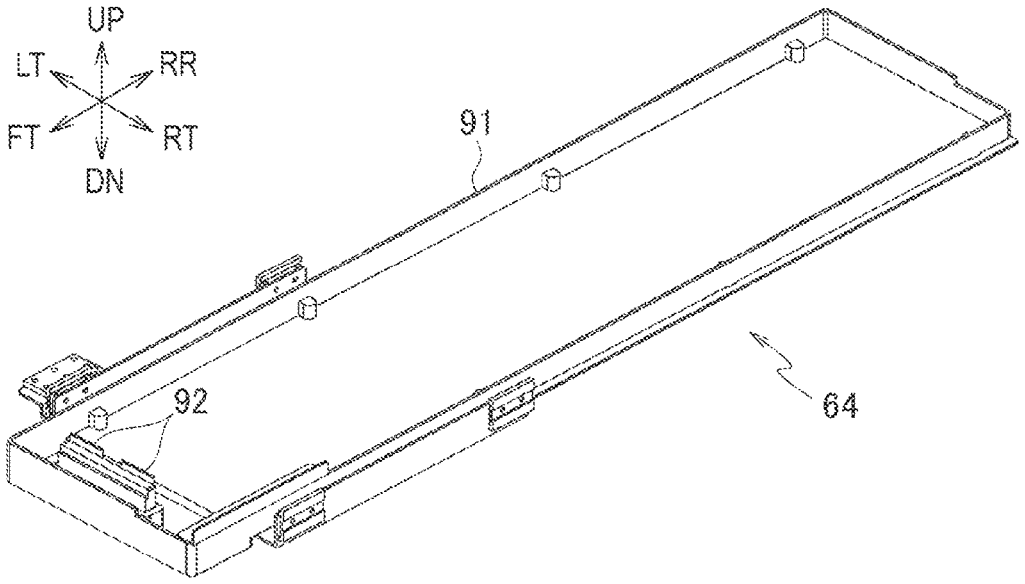
FIG. 10 is a perspective view of a maintainer.
Figure 11:
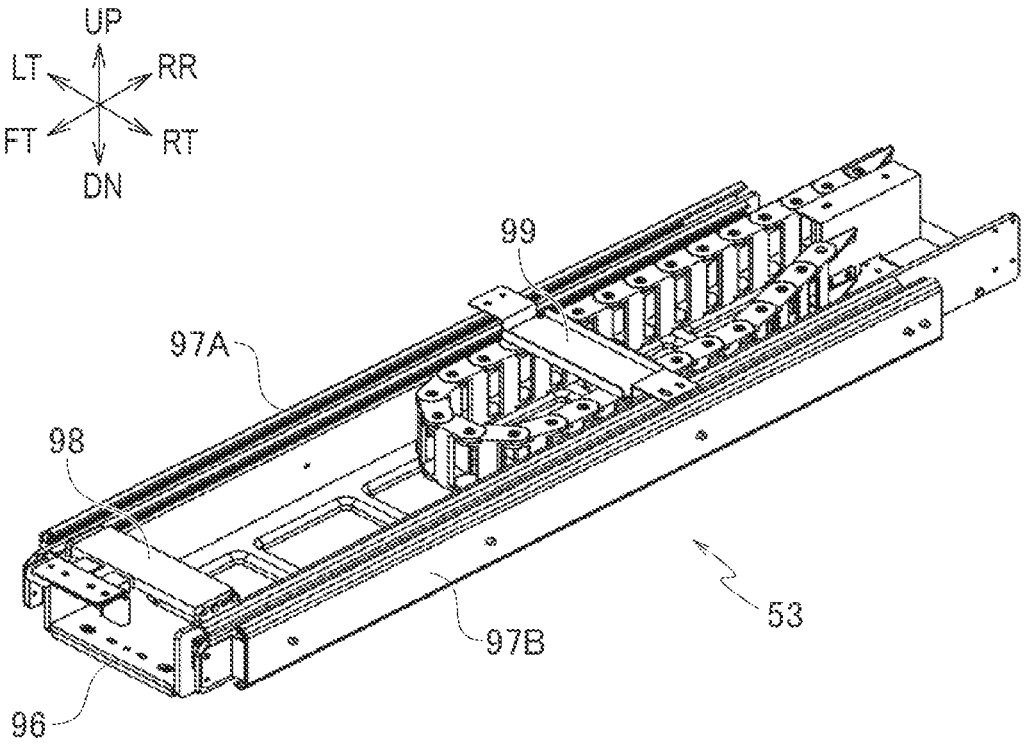
FIG. 11 is a perspective view of a rail unit.

FIG. 1 is a schematic configuration diagram of a printing system 1 including an inkjet printing apparatus 3 in an embodiment of the present invention. FIG. 2 is a control block diagram of the printing system 1 illustrated in FIG. 1. FIG. 3 is a perspective view of the inkjet printing apparatus 3 of the printing system 1 illustrated in FIG. 1. FIG. 4 is a perspective view of a printing unit 51. FIG. 5 is a side view of a print bar unit 52 of the printing unit 51. FIG. 6A is a perspective view of a print bar 56 of the print bar unit 52 and its periphery. FIG. 6B is a side view of the print bar 56 and its periphery. FIG. 7 is a perspective view of the print bar 56. FIGS. 8A and 8B are partially enlarged views illustrating print bar bases 60F and 60R and print bar base supports 61F and 61R. FIG. 9 is a perspective view of a print bar frame 57. FIG. 10 is a perspective view of a maintainer 64. FIG. 11 is a perspective view of a rail unit 53. Note that, in FIG. 1 and FIGS. 3 to 11 and in FIGS. 12A to 17B to be described later, right, left, up, down, front, and rear are denoted by RT, LT, UP, DN, FT, and RR, respectively.

As illustrated in FIGS. 1 and 2, the printing system 1 in the embodiment includes an unwinder 2, the inkjet printing apparatus 3, and a winder 4.

The unwinder 2 unwinds a web W being a long print medium made of film, paper, or the like and sends the web W to the inkjet printing apparatus 3. The unwinder 2 includes a web roll support shaft 11, a brake 12, and an unwinder controller 13.

The web roll support shaft 11 rotatably supports a web roll 16. The web roll support shaft 11 is formed in a long shape extending in a front-rear direction. The web roll 16 is a roll of the web W.

The brake 12 applies brake to the web roll support shaft 11. Tension is thereby applied to the web W between the web roll 16 and a pair of conveyance rollers 44 of the inkjet printing apparatus 3 to be described later.

The unwinder controller 13 controls operations of the units in the unwinder 2. The unwinder controller 13 controls brake force of the brake 12 to adjust the tension of the web W. The unwinder controller 13 includes units such as a CPU, a RAM, a ROM, a hard disk, and a storage including a semiconductor memory and the like. The storage stores commands which cause a processor such as the CPU to perform processes of controlling the operations of the units in the unwinder 2 when executed by the processor.

The inkjet printing apparatus 3 prints images on the web W unwound from the unwinder 2 while conveying the web W. The inkjet printing apparatus 3 includes a housing 21, a conveyor 22, a first printer 23, a second printer 24, and a printing apparatus controller 25 (controller).

The housing 21 houses the units in the inkjet printing apparatus 3. As illustrated in FIG. 3, the housing 21 has front doors 26 and 27. The front doors 26 and 27 open and close a front face of the housing 21. A user or the like can access the conveyor 22, the first printer 23, the second printer 24, and the like by opening the front doors 26 and 27.

The conveyor 22 conveys the web W unwound from the unwinder 2. The conveyor 22 includes guide rollers 31 to 40, twenty under-head supporters 41, a meandering controlling section 42, an encoder 43, the pair of conveyance rollers 44, and a conveyance motor 45.

The guide rollers 31 to 40 guide the web W conveyed in the housing 21. The guide rollers 31 to 40, the under-head supporters 41, the conveyance rollers 44, and meandering controlling rollers 46A and 46B of the meandering controlling section 42 to be described later form a conveyance route of the web W in the housing 21. The guide rollers 31 to 40 rotate by following the conveyed web W. The guide rollers 31 to 40 are formed in a long shape extending in the front-rear direction.

The guide rollers 31 and 32 guide the web W between the unwinder 2 and the meandering controlling section 42. The guide roller 31 is arranged near a left face of the housing 21 in a lower portion of the inkjet printing apparatus 3. The guide roller 32 is arranged between the guide roller 31 and the meandering controlling roller 46A of the meandering controlling section 42 to be described later.

The guide rollers 33 to 39 guide the web W between the meandering controlling section 42 and the pair of conveyance rollers 44. The guide roller 33 is arranged on the left of the meandering controlling roller 46B of the meandering controlling section 42 to be described later. The guide roller 34 is arranged above the guide roller 33. The guide roller 35 is arranged on the right of the guide roller 34 at the same height as the guide roller 34. The guide roller 36 is arranged below the guide roller 35 and above the guide roller 33. The guide roller 37 is arranged on the left of the guide roller 36, near and on the right of the web W between the guide rollers 33 and 34, at substantially the same height as the guide roller 36. The guide roller 38 is arranged on the lower right side of the guide roller 37. The guide roller 39 is arranged below and slightly on the right of the guide roller 38.

The guide roller 40 guides the web W between the pair of conveyance rollers 44 and the winder 4. The guide roller 40 is arranged near a right face of the housing 21 in the lower portion of the inkjet printing apparatus 3.

The under-head supporters 41 support the web W right below the first printer 23 and the second printer 24. The under-head supporters 41 are formed in a long shape extending in the front-rear direction. Ten under-head supporters 41 are arranged in each of an area between the guide rollers 34 and 35 which is right below the first printer 23 and an area between the guide rollers 36 and 37 which is right below the second printer 24. More specifically, two under-head supporters 41 are arranged under each of the printing units 51 in the area between the guide rollers 34 and 35 which is right below the first printer 23 and the area between the guide rollers 36 and 37 which is right below the second printer 24.

The ten under-head supporters 41 in each of the area between the guide rollers 34 and 35 and the area between the guide rollers 36 and 37 are arranged in an arch shape protruding upward. The web W is thereby tensioned and maintained in a stable position between the guide rollers 34 and 35 and between the guide rollers 36 and 37.

The meandering controlling section 42 corrects meandering of the web W. The meandering controlling section 42 includes the meandering controlling rollers 46A and 46B, a meandering controlling motor 47, and a web sensor 48.

The meandering controlling rollers 46A and 46B are rollers for guiding the web W and correcting the meandering of the web W. The meandering controlling rollers 46A and 46B are formed in a long shape extending in the front-rear direction.

The meandering controlling rollers 46A and 46B are each configured such that the angle of the axial direction of the meandering controlling roller to the front-rear direction on a horizontal plane can be adjusted. The meandering controlling roller 46A is arranged on the right of the guide roller 32. The meandering controlling roller 46B is arranged above the meandering controlling roller 46A.

The meandering controlling motor 47 turns the meandering controlling rollers 46A and 46B about an axis orthogonal to the horizontal plane to adjust the angles of axial directions of the meandering controlling rollers 46A and 46B to the front-rear direction on the horizontal plane.

The web sensor 48 detects the positions of edges of the web W in the front-rear direction to control the meandering. The web sensor 48 is arranged near the meandering controlling roller 46B.

The encoder 43 is connected to the guide roller 34 and outputs a pulse signal every time the guide roller 34 rotates by a predetermined angle. The pulse signal outputted from the encoder 43 is used to control conveyance speed of the web W.

The pair of conveyance rollers 44 convey the web W toward the winder 4 while nipping the web W. The pair of conveyance rollers 44 are arranged between the guide rollers 39 and 40.

The conveyance motor 45 rotationally drives the conveyance rollers 44.

The first printer 23 prints images on a front side of the web W. The first printer 23 is arranged above the web W between the guide rollers 34 and 35. The first printer 23 includes five printing units 51. The five printing units 51 eject inks of different colors, respectively. The printing units 51 have the same configuration, except for the colors of the inks to be ejected.

As illustrated in FIG. 4, each of the printing units 51 includes the print bar unit (line head) 52 and a rail unit (guide) 53.

Note that, in the first and second printers 23 and 24, the printing units 51 are installed such that nozzle surfaces 76*a* of head modules 76 to be described later are parallel with the web W arranged in the arch shape between the guide rollers 34 and 35 and between the guide rollers 36 and 37. Accordingly, in the first and second printers 23 and 24, the printing units 51 other than the printing units 51 at the center are installed to be slightly tilted in the left-right direction. However, for the convenience of explanation, the front, rear, up, down, left, and right in each printing unit 51 are described as front, rear, up, down, left, and right in a state where the printing unit 51 is installed without a tilt in the left-right direction as illustrated in FIG. 4.

The print bar unit 52 is a unit which prints images by ejecting the ink to the web W. As illustrated in FIGS. 4 to 9, the print bar unit 52 includes the print bar 56, the print bar frame 57, a front face cover 58, a lifting-lowering motor (lifting-lowering driver) 59, the print bar bases (print bar positioner) 60F and 60R, the print bar base supports 61F and 61R, base motors 62F and 62R, a cooling fan 63, the maintainer 64, and a movement motor (movement driver) 65.

The print bar 56 includes an inkjet head 66, a head base 67, twelve inter-head module members 68, flow path connectors 69F and 69R, a flow path branching portion 70, a flow path merging portion 71, base connectors 72F and 72R, and supported portions 73F and 73R. The print bar 56 can be lifted and lowered in the print bar unit 52.

The inkjet head 66 ejects the ink. The inkjet head 66 has ten head modules 76.

The head modules 76 have multiple nozzles (not illustrated) which are open on the nozzle surfaces 76*a* facing the web W and which are arranged in a main scanning direction (front-rear direction) orthogonal to the conveyance direction of the web W, and eject the ink from the nozzles. The ink is supplied to each of the head modules 76 by an ink circulation mechanism (not illustrated) which circulates the ink along an ink circulation route and supplies the ink to the head module 76. The head modules 76 are arranged in zigzag in the inkjet head 66. Specifically, in the inkjet head 66, two head rows each including five head modules 76 arranged at an equal pitch in the front-rear direction are arranged parallel to each other in the left-right direction, while being shifted from each other by half the pitch in the front-rear direction. Each head module 76 has a ventilation hole (not illustrated) penetrating the head module 76 in the front-rear direction, and cooling air generated by drive of the cooling fan 63 can pass through this ventilation hole.

The head base 67 holds the head modules 76. The head base 67 is made of a rectangular plate shaped member. Attachment opening portions for attaching the head modules 76 are formed in the head base 67. The head modules 76 are inserted into the attachment openings and fixed such that the nozzle surfaces 76*a* protrude downward from the head base 67.

The inter-head module members 68 are each a member which is arranged between the head modules 76 adjacent to each other in the front-rear direction and which forms an air flow path between the head modules 76. The inter-head module members 68 are also arranged between the flow path connector 69F and the front-most head module 76 in the left head row and between the flow path merging portion 71 and the rear-most head module 76 in the left head row, and form the air flow path at these positions. Moreover, the inter-head module members 68 are also arranged between the flow path branching portion 70 and the front-most head module 76 in the right head row and between the flow path connector 69R and the rear-most head module 76 in the right head row, and form the air flow path at these positions. Ventilation holes (not illustrated) are formed in the inter-head module members 68 to penetrate the inter-head module members 68 in the front-rear direction. The ventilation holes of the inter-head module members 68 communicate with the ventilation holes of the head modules 76.

The flow path connector 69F is arranged between the flow path branching portion 70 and the inter-head module member 68 arranged adjacent to and in front of the front-most head module 76 in the left head row, and forms the air flow path at that position. The flow path connector 69R is arranged between the flow path merging portion 71 and the inter-head module member 68 arranged adjacent to and behind the rear-most head module 76 in the right head row, and forms the air flow path at that position. Ventilation holes (not illustrated) are formed in the flow path connectors 69F and 69R to penetrate the flow path connectors 69F and 69R in the front-rear direction. The ventilation holes of the flow path connectors 69F and 69R communicate with the ventilation holes of the adjacent inter-head module members 68, respectively.

The flow path branching portion 70 causes the air flow path from the base connector 72F to branch into the air flow path in the left head row and the air flow path in the right head row. The flow path branching portion 70 is provided to stand upright in a front end portion of the head base 67. The flow path branching portion 70 has a hollow structure and has an opening portion (not illustrated) open to a space inside the base connector 72F. Moreover, the flow path branching portion 70 has an opening portion (not illustrated) open to the ventilation hole of the flow path connector 69F and the ventilation hole of the inter-head module member 68 in front of the front-most head module 76 in the right head row.

The flow path merging portion 71 causes the air flow path in the left head row and the air flow path in the right head row to merge. The flow path merging portion 71 is provided to stand upright in a rear end portion of the head base 67. The flow path merging portion 71 has a hollow structure and has an opening portion (not illustrated) open to the ventilation hole of the flow path connector 69R and the ventilation hole of the inter-head module member 68 behind the rear-most head module 76 in the left head row. Moreover, the flow path merging portion 71 has an opening portion (not illustrated) open to a space inside the base connector 72R.

The base connector 72F is connected to the print bar base 60F in the printing and forms part of the air flow path through which the cooling air generated by the cooling fan 63 passes. The base connector 72F is arranged on a front face of the flow path branching portion 70. The base connector 72F has a hollow structure and has an opening portion (not illustrated) in a portion in contact with the flow path branching portion 70. The base connector 72F includes an opening portion 72*a* through which the space inside the base connector 72F and a space inside the print bar base 60F communicate with each other when the base connector 72F is connected to the print bar base 60F.

The base connector 72R is connected to the print bar base 60R in the printing and forms part of the air flow path through which the cooling air generated by the cooling fan 63 passes. The base connector 72R is arranged on a rear face of the flow path merging portion 71. The base connector 72R has a structure similar to the base connector 72F and has an opening portion (not illustrated) in a portion in contact with the flow path merging portion 71. The space inside the base connector 72R and a space inside the print bar base 60R communicate with each other through an opening portion 72*a* of the base connector 72R when the base connector 72R is connected to the print bar base 60R.

The supported portions 73F and 73R are portions supported respectively by the print bar bases 60F and 60R in standby of the inkjet printing apparatus 3 and maintenance of the inkjet head 66. The supported portion 73F is arranged on the front face of the flow path branching portion 70, below the base connector 72F. The supported portion 73R is arranged on the rear face of the flow path merging portion 71, below the base connector 72R.

The print bar frame 57 forms a frame of the print bar unit 52, and holds the print bar 56 and the like. The print bar frame 57 includes a pair of lower frames 81A and 81B, a front connector 82, a rear connection plate 83, a front plate 84, a rear plate 85, and two upper frames 86.

The lower frames 81A and 81B are made of long narrow plate-shaped members extending in the front-rear direction, and are arranged away from each other in the left-right direction. Surfaces of the lower frames 81A and 81B facing each other are provided with rails 87 which guide movement of the maintainer 64 in the front-rear direction.

The front connector 82 is a member which connects front end portions of the lower frames 81A and 81B to each other. A handle 88 is installed on a front surface of the front connector 82. A user or the like grips the handle 88 when pulling out the print bar unit 52 from the housing 21 toward the front side and pushing the print bar unit 52 toward the inside of the housing 21.

The rear connection plate 83 is a plate-shaped member which connects rear portions of the lower frames 81A and 81B to each other and on which the movement motor 65 and the like are mounted.

The front plate 84 is a plate-shaped member on which the print bar base support 61F and the like are installed. The front plate 84 is provided to stand upright in the front end portion portions of the lower frames 81A and 81B.

The rear plate 85 is a plate-shaped member on which the print bar base support 61R and the like are installed. The rear plate 85 is provided to stand upright on the lower frames 81A and 81B, behind the front plate 84. The print bar 56 is lifted and lowered in an area between the front plate 84 and the rear plate 85.

The upper frames 86 are long members connecting upper end portions of the front plate 84 and the rear plate 85.

The front face cover 58 is a member which covers a front face portion of the print bar unit 52. The front face cover 58 is installed in front of the front plate 84.

The lifting-lowering motor 59 lifts and lowers the print bar 56.

The print bar bases 60F and 60R support the print bar 56 and determine the height position of the print bar 56 in the standby of the printing system 1 and the maintenance of the inkjet head 66. Moreover, the print bar bases 60F and 60R form part of the flow path of the cooling air supplied to the inkjet head 66 in the printing. The print bar bases 60F and 60R have similar structures and are formed in hollow shapes. As illustrated in FIGS. 8A and 8B, the print bar bases 60F and 60R have supporting surfaces 60*a* and contact surfaces 60*b*.

The supporting surfaces 60*a* are surfaces supporting the supported portions 73F and 73R of the print bar 56 in the standby of the printing system 1 and the maintenance of the inkjet head 66.

As illustrated in FIG. 6A, an opening portion 60*c* is formed in each of the supporting surfaces 60*a*. The opening portion 60*c* of the print bar base 60F functions as an air inlet of the flow path of the cooling air supplied to the inkjet head 66 in the printing. The opening portion 60*c* of the print bar base 60R functions as an air outlet of the flow path of the cooling air supplied to the inkjet head 66 in the printing. In the printing, the cooling fan 63 is connected to the opening portion 60*c* of the print bar base 60R to supply the cooling air to the inkjet head 66. Note that FIGS. 6A and 6B are views of the print bar and its periphery in the printing.

The contact surfaces 60*b* are surfaces coming into contact with the base connectors 72F and 72R in the printing. Opening portions (not illustrated) through which the spaces inside the print bar bases 60F and 60R and the spaces inside the base connectors 72F and 72R communicate are formed in the contact surfaces 60*b*.

The print bar bases 60F and 60R are configured such that the state thereof is switchable between a deployment state and a retreat state.

The deployment state is the state of the print bar bases 60F and 60R illustrated by the solid lines in FIGS. 8A and 8B and is a state in which the supporting surfaces 60*a* are horizontal. The deployment state is a state of the print bar bases 60F and 60R in the case where the print bar bases 60F and 60R support the print bar 56 in the standby of the printing system 1 and the maintenance of the inkjet head 66. Moreover, the deployment state is a state of the print bar bases 60F and 60R in the case where the print bar bases 60F and 60R form part of the flow path of the cooling air in the printing. In the deployment state, the print bar bases 60F and 60R at least partially exist on a lifting-lowering trajectory of the print bar 56.

The retreat state is a state of the print bar bases 60F and 60R illustrated by the two-dot chain lines in FIGS. 8A and 8B, and is a state where the print bar bases 60F and 60R are retreated from the lifting-lowering trajectory of the print bar 56.

The retreat state of the print bar base 60F is a state where the print bar base 60F is turned counterclockwise in FIG. 8A from the deployment state by a predetermined angle about a supporting shaft 61*a* of the print bar base support 61F to be described later. The rear end portion of the print bar base 60F in the retreat state is retreated toward the front side from the deployment state. The print bar base 60F is thereby set to a state retreated from the lifting-lowering trajectory of the print bar 56.

The retreat state of the print bar base 60R is a state where the print bar base 60R is turned clockwise in FIG. 8B from the deployment state by a predetermined angle about a supporting shaft 61*a* of the print bar base support 61R. The front end portion of the print bar base 60R in the retreat state is retreated toward the rear side from the deployment state. The print bar base 60R is thereby set to a state retreated from the lifting-lowering trajectory of the print bar 56.

The print bar base supports 61F and 61R support the print bar bases 60F and 60R, respectively. The print bar base supports 61F and 61R are fixed to the front plate 84 and the rear plate 85, respectively. The print bar base supports 61F and 61R have the supporting shafts 61*a*, and the print bar bases 60F and 60R are turnably supported by the supporting shafts 61*a*.

The base motors 62F and 62R turn the print bar bases 60F and 60R, respectively, to switch the print bar bases 60F and 60R between the deployment state and the retreat state.

The cooling fan 63 generates the cooling air for cooling the inkjet head 66. The cooling fan 63 is installed to be connected to the opening portion 60*c* of the print bar base 60R in the deployment state.

The maintainer 64 cleans the nozzle surfaces 76*a* of the head modules 76 of the inkjet head 66. The maintainer 64 is configured to be movable in the front-rear direction along the rails 87 of the lower frames 81A and 81B. As illustrated in FIG. 10, the maintainer 64 includes a maintenance pan (ink receiver) 91 and two wipers 92.

The maintenance pan 91 receives the ink from the inkjet head 66. Specifically, the maintenance pan 91 receives the ink which is discharged from the head modules 76 of the inkjet head 66 by purging in the maintenance, the ink which is removed from the nozzle surfaces 76*a* by wiping with the wipers 92, and the like. The maintenance pan 91 has a tray shape which is rectangular in a plan view.

The wipers 92 are members which wipe the nozzle surfaces 76*a*. The wipers 92 are made of an elastically-deformable material such as rubber, and are formed in a plate shape. The two wipers 92 are arranged side by side in the left-right direction. The left wiper 92 wipes the nozzle surfaces 76*a* of the head modules 76 in the left head row. The right wiper 92 wipes the nozzle surfaces 76*a* of the head modules 76 in the right head row. The two wipers 92 are fixed to a front end portion of the maintenance pan 91.

The movement motor 65 moves the maintainer 64 between a deployment position and a retreat position. The deployment position is a position under (directly below) the inkjet head 66 in the standby of the printing system 1 and the maintenance of the inkjet head 66. The retreat position is a position where the maintainer 64 is retreated from the deployment position toward the rear side.

The rail unit 53 guides movement of the print bar unit 52 in the front-rear direction (print bar movement direction) which is a direction intersecting the conveyance direction of the web W. The guiding by the rail unit 53 allows the print bar unit 52 to move to and from a print position (position illustrated in FIG. 12A) at which the print bar unit 52 is housed in the housing 21, a pulled-out position (position illustrated in FIG. 12B) which is in front of the print position and which is the position of the print bar unit 52 pulled out from the housing 21 toward the outside, and a pushed-in position (position illustrated in FIG. 12C) which is behind the print position and which is the position of the print bar unit 52 pushed in from the print position toward the inside of the housing 21. The rail unit 53 is arranged above the print bar unit 52. The rail unit 53 includes a slider 96 and rails 97A and 97B.

The slider 96 is a member which slides in the front-rear direction along the rails 97A and 97B. The print bar unit 52 is connected to the slider 96. The print bar unit 52 thereby moves in the front-rear direction together with the slider 96. A block 98 is arranged in a front end portion of the slider 96. The block 98 abuts on a stopper 99 arranged at a predetermined position in the housing 21 when the print bar unit 52 is pushed rearward (toward the inside of the housing 21), and thereby stops the print bar unit 52.

The rails 97A and 97B allow the slider 96 and the print bar unit 52 to slide in the front-rear direction. The rails 97A and 97B are fixed in the housing 21.

The second printer 24 prints an image on a back side of the web W. The second printer 24 is arranged above the web W between the guide rollers 36 and 37. Like the first printer 23, the second printer 24 includes five printing unit 51 which eject inks of different colors, respectively.

The printing apparatus controller 25 controls the operations of the units (the conveyor 22, the first printer 23, and the second printer 24) in the inkjet printing apparatus 3. The printing apparatus controller 25 includes units such as a CPU, a RAM, a ROM, a hard disk, and a storage including a semiconductor memory and the like. The storage stores commands which cause a processor such as the CPU to perform processes of controlling the operations of the units in the inkjet printing apparatus 3 when executed by the processor.

In the printing, the printing apparatus controller 25 prints images on the web W by causing the inkjet head 66 in the first and second printers 23 and 24 to eject the inks, while conveying the web W by rotationally driving the conveyance rollers 44 with the conveyance motor 45.

Moreover, in the maintenance of the inkjet head 66, the printing apparatus controller 25 causes the lifting-lowering motor 59 to set the print bar 56 at a standby height position (maintenance position) to be described later. In addition, the printing apparatus controller 25 causes the movement motor 65 to set the maintainer 64 at the deployment position. Then, the printing apparatus controller 25 performs the purging by forcedly discharging the inks from the nozzles of the head modules 76 and causing the inks to attach to the nozzle surfaces 76*a*. Thereafter, the printing apparatus controller 25 causes the movement motor 65 to move the maintainer 64 from the deployment position to the retreat position and thereby causes the wipers 92 to wipe the nozzle surfaces 76*a* of the head modules 76 in the inkjet head 66.

The winder 4 winds the web W subjected to printing in the inkjet printing apparatus 3. The winder 4 includes a winding shaft 101, a winding motor 102, and a winder controller 103.

The winding shaft 101 winds and holds the web W. The winding shaft 101 is formed in a long shape extending in the front-rear direction.

The winding motor 102 rotates the winding shaft 101 clockwise in FIG. 1. The winding shaft 101 winds the web W by being rotated.

The winder controller 103 controls operations of the units in the winder 4. The winder controller 103 controls drive of the winding motor 102. The winder controller 103 includes units such as a CPU, a RAM, a ROM, a hard disk, and a storage including a semiconductor memory and the like. The storage stores commands which cause a processor such as the CPU to perform processes of controlling the operations of the units in the winder 4 when executed by the processor.

Next, the position of the print bar unit 52 in the inkjet printing apparatus 3 in the front-rear direction is described.

As described above, the print bar unit 52 is movable in the front-rear direction to and from the print position, the pulled-out position, and the pushed-in position. The user or the like can slide and move the print bar unit 52 in the front-rear direction by gripping the handle 88.

Figure 12A:
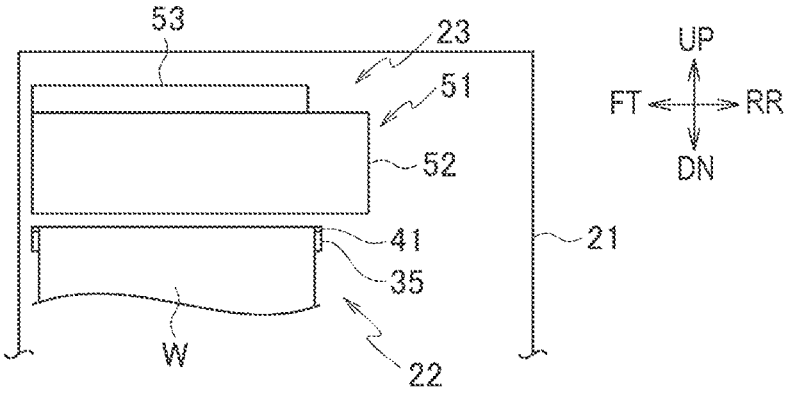
FIG. 12A is a view explaining a print position of the print bar unit.

The print position is the position of the print bar unit 52 in the printing of the web W, and is the position of the print bar unit 52 illustrated in FIG. 12A. Note that FIG. 4 described above is a perspective view of the printing unit 51 in the state where the print bar unit 52 is at the print position.

Figure 12B:
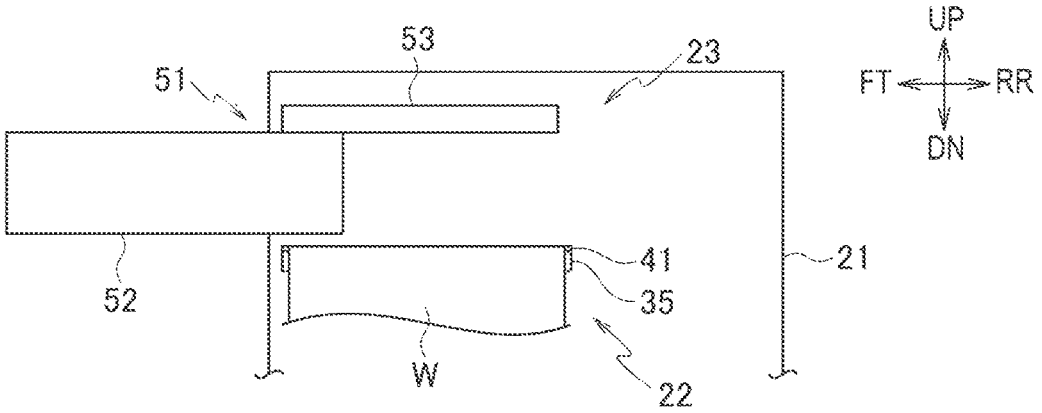
FIG. 12B is a view explaining a pulled-out position of the print bar unit.

The pulled-out position is the position of the print bar unit 52 pulled out forward from the housing 21 toward the outside, and is the position of the print bar unit 52 illustrated in FIG. 12B. The print bar unit 52 is set to the pulled-out position when operations such as replacement of the inkjet head 66 are performed.

Figure 13:
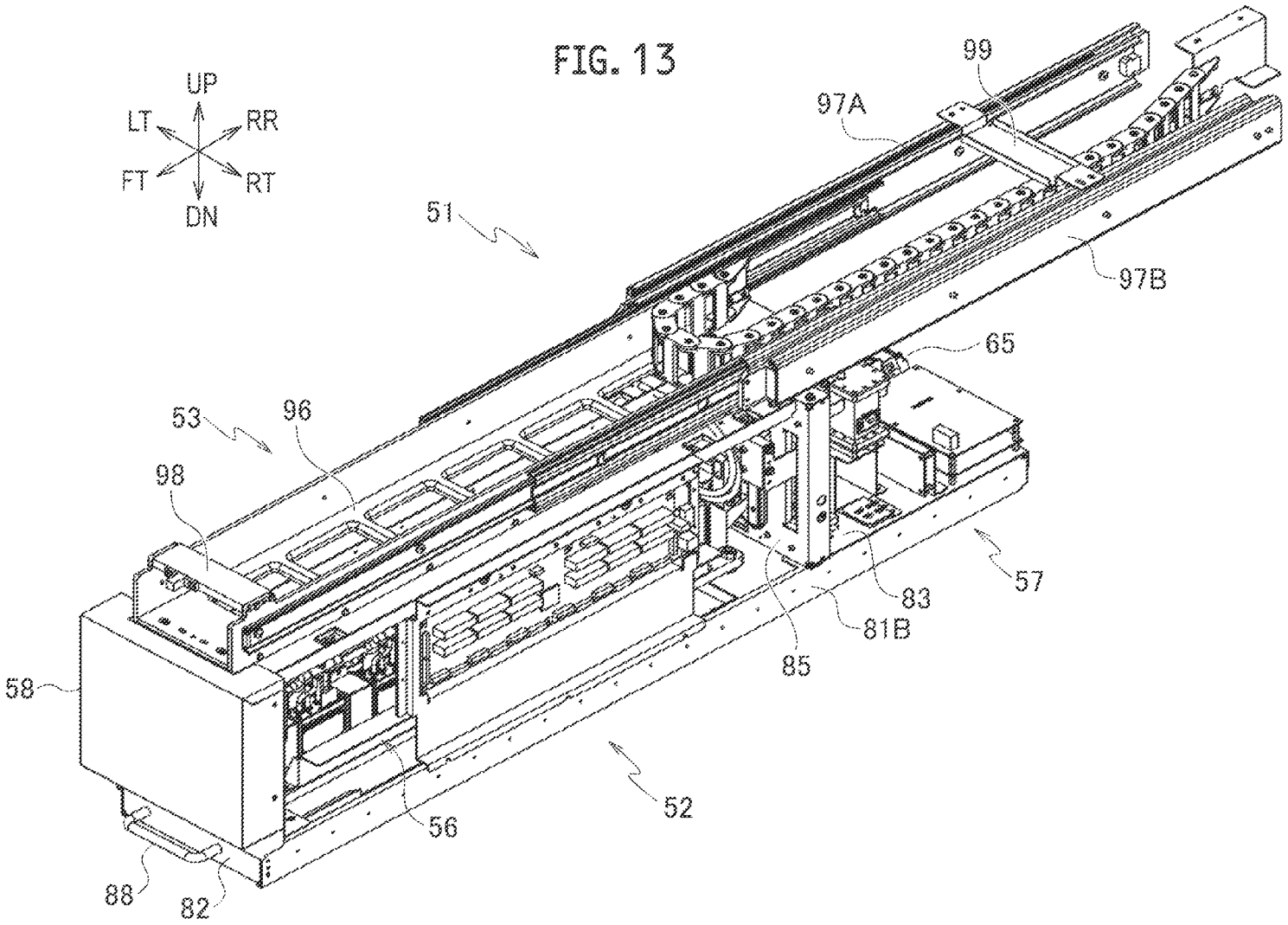
FIG. 13 is a perspective view of the printing unit in a state where the print bar unit is at the pulled-out position.

FIG. 13 illustrates a perspective view of the printing unit 51 in which the print bar unit 52 is at the pulled-out position. As illustrated in FIGS. 12B and 13, the print bar unit 52 is set to the pulled-out position by being moved such that a large part of the print bar unit 52 is located in front of the front ends of the rails 97A and 97B. Note that a stopper (not illustrated) which prevents the print bar unit 52 from coming off is provided on the rail 97A.

Figure 12C:
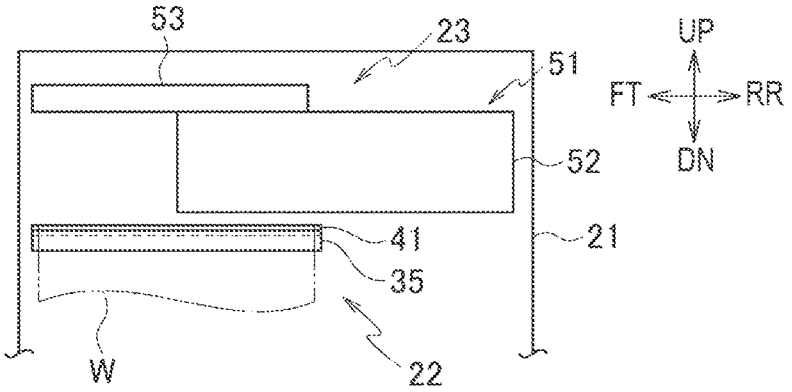
FIG. 12C is a view explaining a pushed-in position of the print bar unit.

The pushed-in position is the position of the print bar unit 52 pushed in from the print position toward the inside (rear side) of the housing 21, and is the position of the print bar unit 52 illustrated in FIG. 12C. The print bar unit 52 is set to the pushed-in position when the web roll 16 is set to the unwinder 2 and the web W is laid along the conveyance route of the conveyor 22.

As illustrated in FIG. 12C, the pushed-in position is a position of the print bar unit 52 where one-side portion of the conveyance route in the width direction (front-rear direction), which is under (directly below) the print bar when the print bar unit is at the print position, is exposed (that is, one-side portion of the conveyance route of the web W in the front-rear direction is not covered with the print bar unit 52 in an up-down direction), while an opposite-side (remaining) portion (unexposed portion) of the conveyance route of the web W in the width direction is covered with a portion of the print bar unit 52 in the up-down direction. For example, the pushed-in position is a position of the print bar unit 52 where the front half of the conveyance route, which is under the print bar unit when the print bar unit is at the print position, is exposed, while the rear half of the conveyance route is covered with a front portion of the print bar unit 52 in the up-down direction.

In this case, the conveyance route of the web W under the print bar unit 52 is a route formed by the under-head supporters 41. "One-side portion of the conveyance route in the width direction (front-rear direction), which is under the print bar when the print bar unit is at the first position, is exposed" means that one-side portions of the under-head supporters 41 in the front-rear direction are not covered with the print bar unit 52 in the up-down direction.

Figure 14:
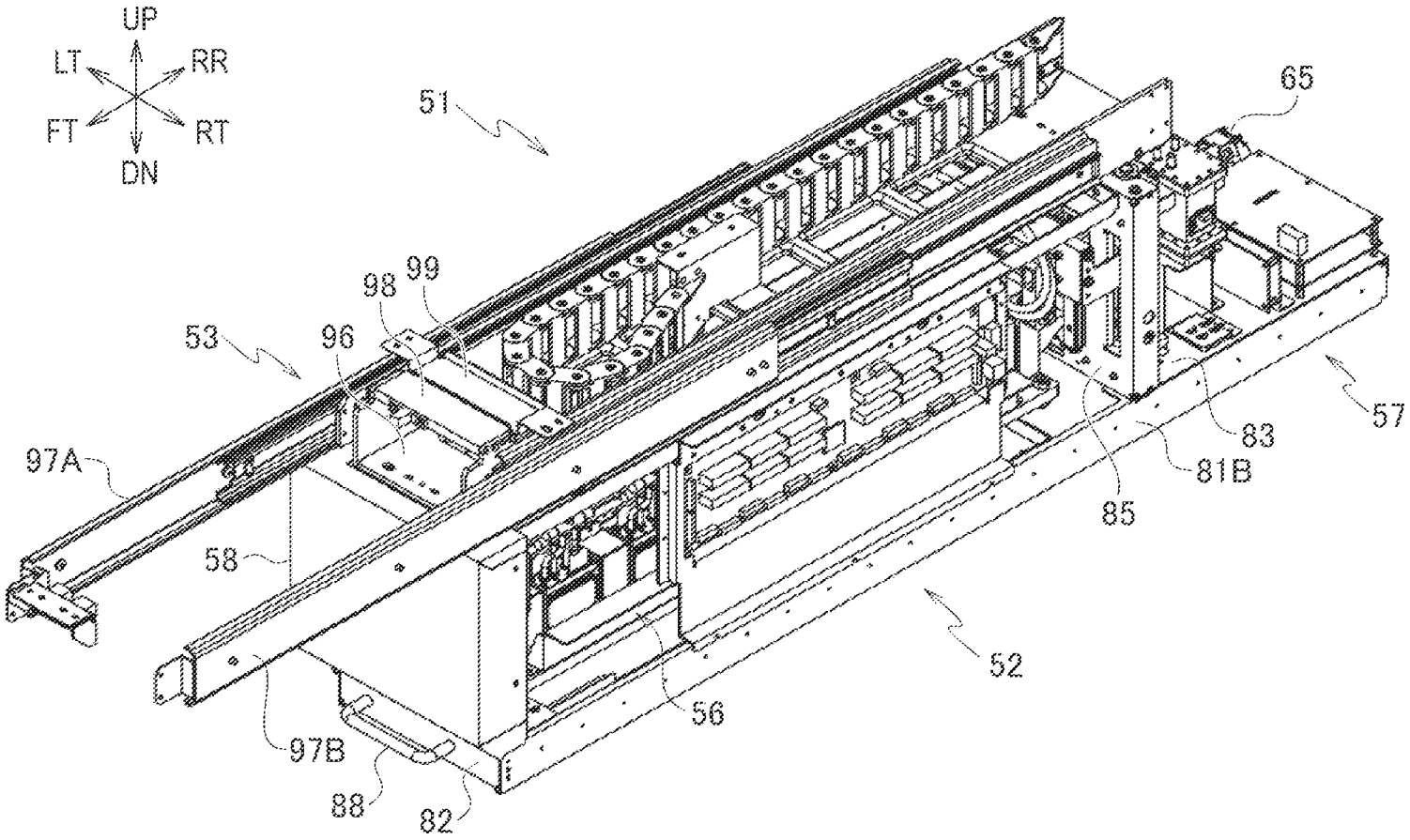
FIG. 14 is a perspective view of the printing unit in a state where the print bar unit is at the pushed-in position.

FIG. 14 illustrates a perspective view of the printing unit 51 in which the print bar unit 52 is at the pushed-in position. As illustrated in FIG. 14, the print bar unit 52 is set to the pushed-in position by causing the block 98 to abut on the stopper 99.

Note that, in FIGS. 12A to 12C, although the position of the print bar unit 52 in the printing unit 51 of the first printer 23 is illustrated, the position of the print bar unit 52 in each of the printing units 51 of the second printer 24 is also similar to this.

As described above, the print bar unit 52 is set to the pushed-in position when the web roll 16 is set to the unwinder 2 and the web W is laid along the conveyance route of the conveyor 22. For example, when the printing is to be performed for the first time in the printing system 1, the user or the like sets the web roll 16 to the unwinder 2 and lays the web W along the conveyance route of the conveyor 22.

In this case, the user or the like manually pushes in all of the print bar units 52 in the first and second printers 23 and 24 from the print position to set the print bar units 52 to the pushed-in position. Then, the user or the like accesses the conveyance route of the web W through spaces on the near side of the print bar units 52 and performs the work of laying the web W along the conveyance route. The user or the like can thereby access the conveyance route, which is under the print bar units 52 when the print bar units 52 are at the print position, without removing the print bar units 52. Hence, operability of laying the web W is improved for the user or the like.

After the laying of the web W is completed, the user manually replaces all of the print bar units 52 in the first and second printers 23 and 24 at the pushed-in position to the print position.

Next, description is given of operations in the printing by the printing system 1.

Figure 15A:
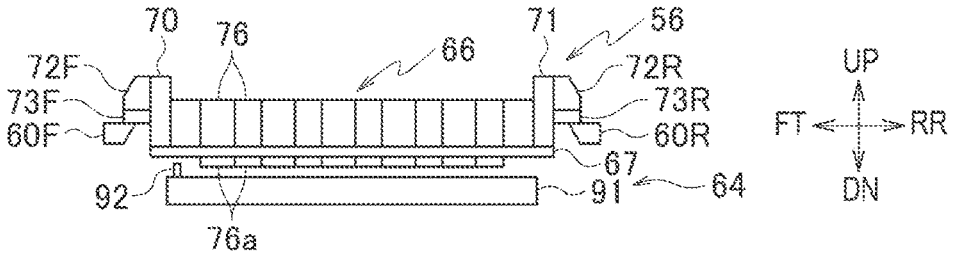
FIGS. 15A to 15E are operation diagrams for explaining lifting and lowering of the print bar and movement of the maintainer.
Figure 16A:
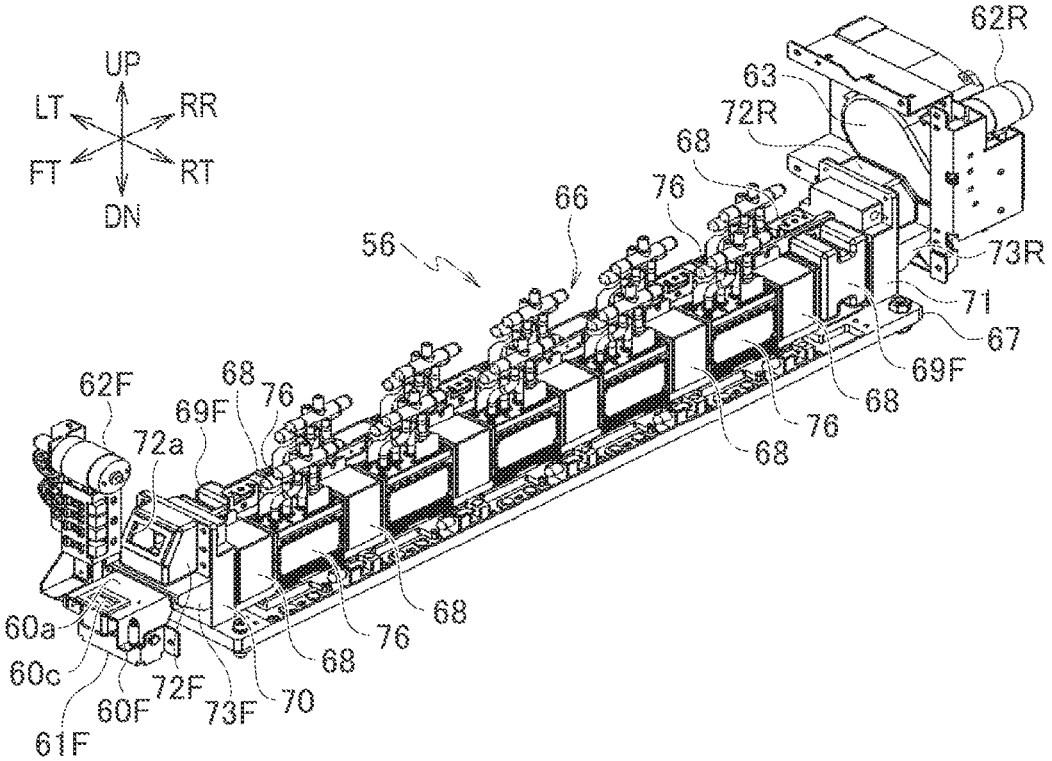
FIG. 16A is a perspective view of the print bar and its periphery in a state where the print bar is set at a standby height position.
Figure 16B:
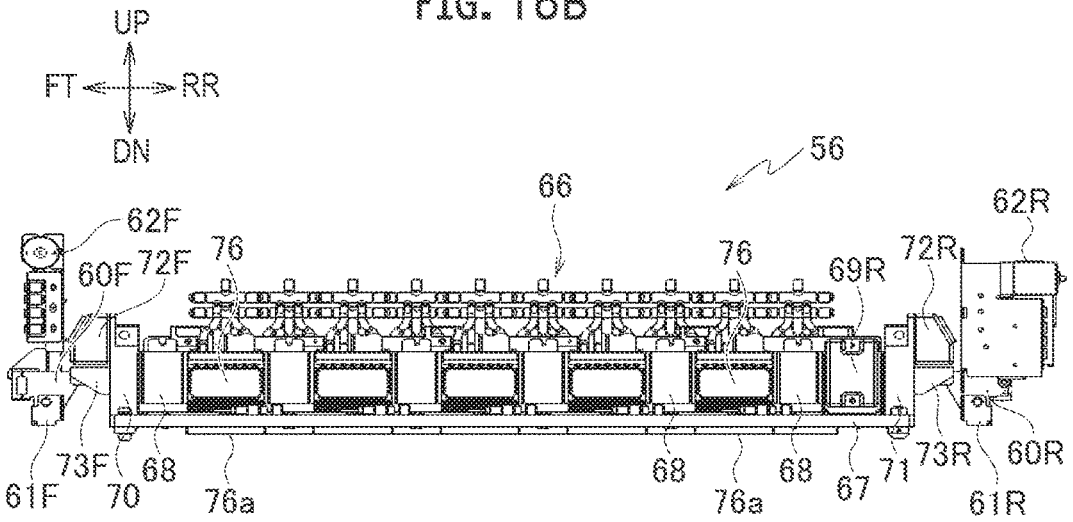
FIG. 16B is a side view of the print bar and its periphery in the same state as FIG. 16A.

During the standby before the start of operations by the printing system 1, each of the print bars 56 is set to the standby height position. As illustrated in FIGS. 15A, 16A, and 16B, the standby height position is a height position where the print bar 56 is supported by the print bar bases 60F and 60R in the deployment state.

Moreover, during the standby of the printing system 1, as illustrated in FIG. 15A, the maintainer 64 is at the deployment position. When the print bar 56 is at the standby height position and the maintainer 64 is at the deployment position, as illustrated in FIG. 15A, the wipers 92 are located in front of a front end of the most-front head module 76 in the inkjet head 66. Moreover, upper ends of the wipers 92 are located above the nozzle surfaces 76*a* which are lower surfaces of the head modules 76.

Figure 15B:
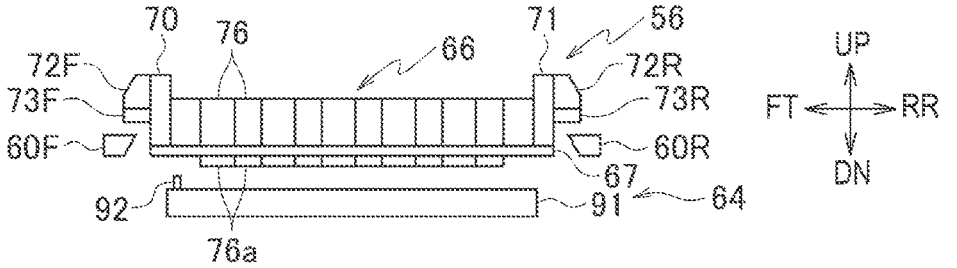

In the case of performing the printing, upon input of a print job, the printing apparatus controller 25 first controls the lifting-lowering motor 59 to lift the print bar 56 to a predetermined height above the standby height position as illustrated in FIG. 15B. The print bar 56 is thereby set to a state where the nozzle surfaces 76*a* are located above the upper ends of the wipers 92.

Next, the printing apparatus controller 25 controls the movement motor 65 to move the maintainer 64 from the deployment position to the retreat position.

Figure 15C:
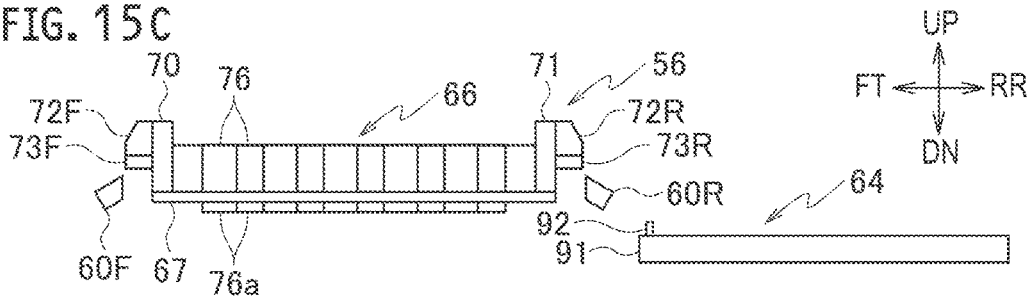
Figure 17A:
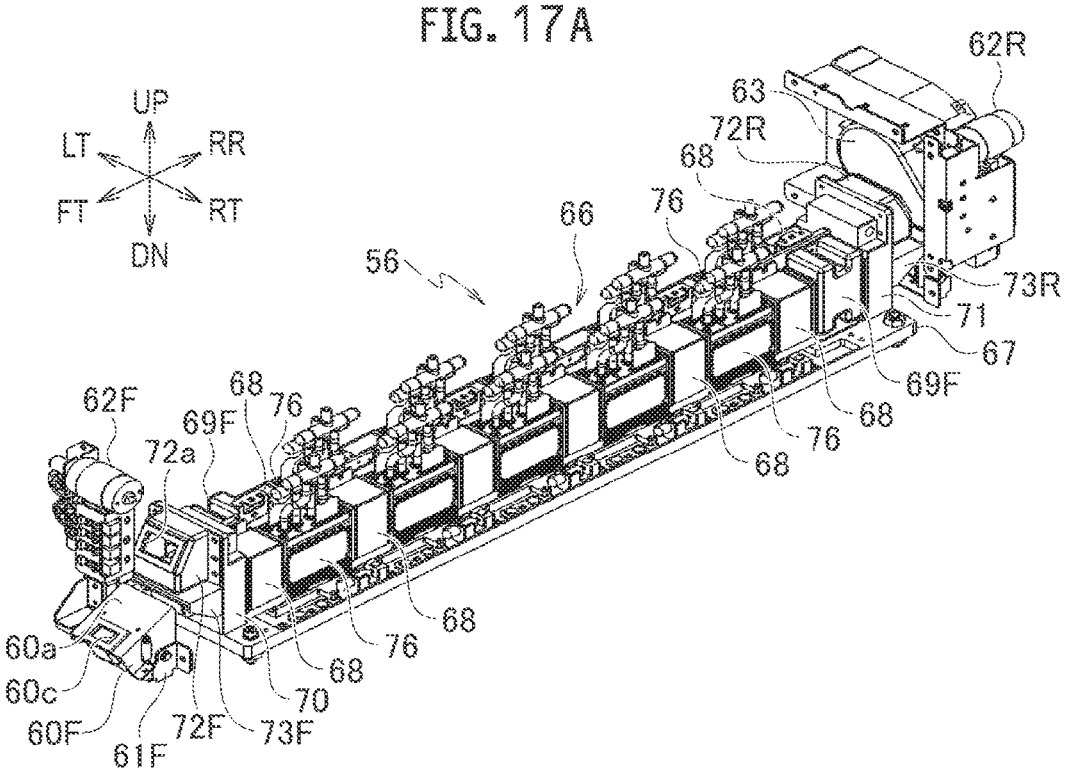
FIG. 17A is a perspective view of the print bar and its periphery in a state where the print bar is at a predetermined height above the standby height position and the print bar bases are set to a retreat state.
Figure 17B:
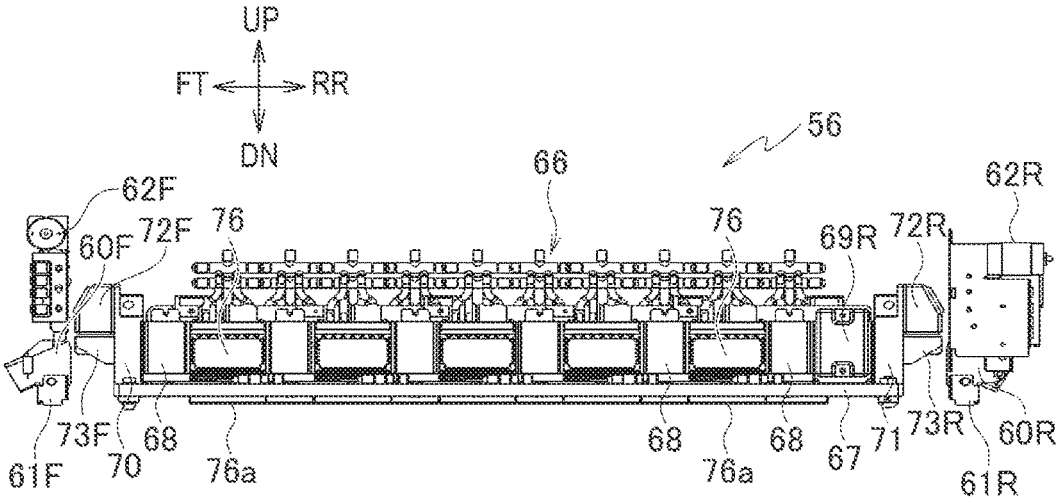
FIG. 17B is a side view of the print bar and its periphery in the same state as FIG. 17A.

Then, the printing apparatus controller 25 controls the base motors 62F and 62R to switch the print bar bases 60F and 60R from the deployment state to the retreat state as illustrated in FIGS. 15C, 17A, and 17B. The print bar bases 60F and 60R are thereby set to a state where the print bar bases 60F and 60R are retreated from the lifting-lowering trajectory of the print bar 56.

Figure 15D:
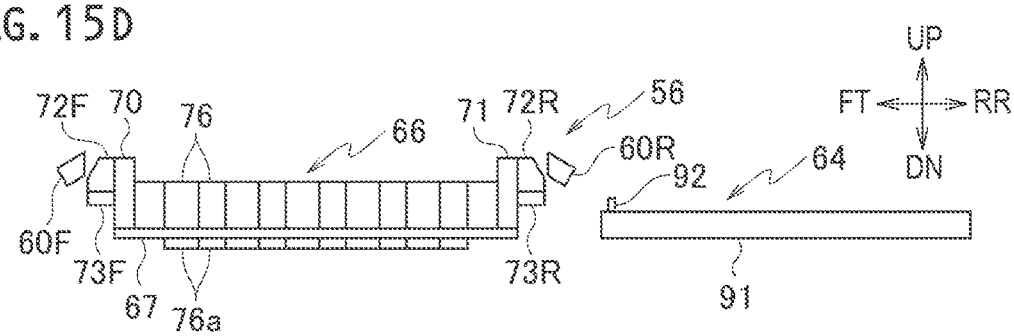

Next, the printing apparatus controller 25 controls the lifting-lowering motor 59 to lower the print bar 56 to the print height position below the standby height position as illustrated in FIG. 15D. The print height position is a height position of the print bar 56 in the printing. The print bar 56 is set to the print height position by causing the head base 67 to be supported by a positioning member (not illustrated) provided in the conveyor 22.

Figure 15E:
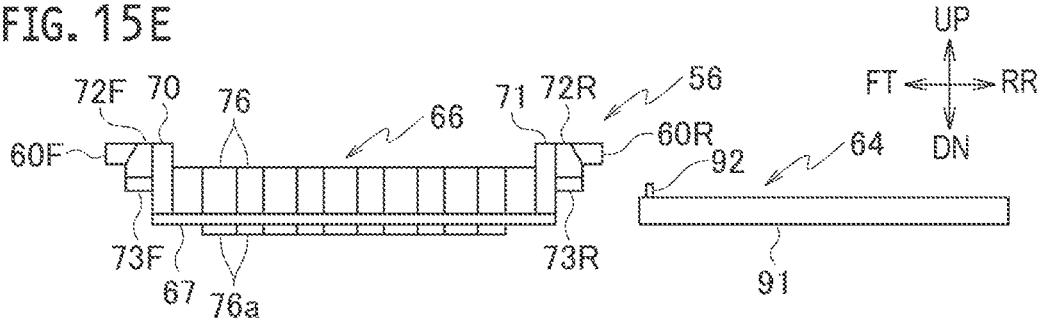

Then, the printing apparatus controller 25 controls the base motors 62F and 62R to switch the print bar bases 60F and 60R from the retreat state to the deployment state as illustrated in FIGS. 15E, 6A, and 6B.

The contact surfaces 60*b* of the print bar bases 60F and 60R thereby come into contact with the base connectors 72F and 72R, respectively. Moreover, the space inside the print bar base 60F and the space inside the base connector 72F communicate with each other via the opening portion (not illustrated) in the contact surface 60*b* of the print bar base 60F and the opening portion 72*a* in the base connector 72F. Furthermore, the space inside the print bar base 60R and the space inside the base connector 72R communicate with each other via the opening portion (not illustrated) in the contact surface 60*b* of the print bar base 60R and the opening portion 72*a* in the base connector 72R.

The flow path of the cooling air from the print bar base 60F to the print bar base 60R is thereby formed. This flow path of the cooling air is formed by the print bar bases 60F and 60R, the base connectors 72F and 72R, the flow path branching portion 70, the inter-head module members 68, the head modules 76, the flow path connectors 69F and 69R, and the flow path merging portion 71.

The flow path of the cooling air extends from the print bar base 60F to the base connector 72F and then branches into the flow path in the left head row and the flow path in the right head row at the flow path branching portion 70. The flow path in the left head row is a flow path formed by the flow path connector 69F, the five head modules 76 in the left head row, and the six inter-head module members 68 arranged in front of and behind the head modules 76 in the left head row. The flow path in the right head row is a flow path formed by the five head modules 76 in the right head row, the six inter-head module members 68 arranged in front of and behind the head modules 76 in the right head row, and the flow path connector 69R. The flow path in the left head row and the flow path in the right head row merge at the flow path merging portion 71. Then, the flow path of the cooling air extends to the base connector 72R and reaches the print bar base 60R. The cooling fan 63 is connected to the opening portion 60*c* of the print bar base 60R.

Next, the unwinder controller 13, the printing apparatus controller 25, and the winder controller 103 start the conveyance of the web W.

Specifically, the unwinder controller 13 starts drive of the brake 12, the printing apparatus controller 25 starts drive of the conveyance motor 45, and the winder controller 103 starts drive of the winding motor 102. This causes the web W to be conveyed from the unwinder 2 to the winder 4. Applying brake to the web roll support shaft 11 with the brake 12 of the unwinder 2 causes the web W to be conveyed with tension applied to the web W between the web roll 16 and the conveyance rollers 44.

After the conveyance of the web W is started, the printing apparatus controller 25 controls the inkjet heads 66 in the first and second printers 23 and 24 to print images on the web W based on the print job.

Moreover, the printing apparatus controller 25 starts drive of the cooling fan 63. Driving the cooling fan 63 causes air to be sucked in from the opening portion 60*c* of the print bar base 60F toward the cooling fan 63 via the aforementioned flow path of the cooling air. The cooling air which passes through the aforementioned flow path of the cooling air and cools the head modules 76 of the inkjet head 66 is thereby generated.

During the conveyance of the web W, the printing apparatus controller 25 calculates the conveyance speed of the web W based on the pulse signal outputted from the encoder 43. Then, the printing apparatus controller 25 controls a current to be supplied to the conveyance motor 45 such that the difference between the calculated conveyance speed and print conveyance speed (target speed) becomes zero. The conveyance speed of the web W is thereby controlled to be constant.

Moreover, the printing apparatus controller 25 calculates output torque of the conveyance motor 45 corresponding to the current supplied to the conveyance motor 45. The value of the output torque of the conveyance motor 45 corresponding to the supplied current can be calculated from motor characteristics of the conveyance motor 45. The unwinder controller 13 adjusts the brake force (output torque) of the brake 12 such that the difference between the output torque of the brake 12 and the output torque of the conveyance motor 45 calculated by the printing apparatus controller 25 becomes a target torque difference corresponding to target tension of the web W. The tension of the web W is thereby controlled to be constant.

When the printing based on the print job is completed, the printing apparatus controller 25 stops the cooling fan 63.

Then, the unwinder controller 13, the printing apparatus controller 25, and the winder controller 103 terminate the conveyance of the web W. Specifically, the unwinder controller 13 stops the brake 12, the printing apparatus controller 25 stops the conveyance motor 45, and the winder controller 103 stops the winding motor 102.

Moreover, the printing apparatus controller 25 replaces the maintainer 64 and the print bar 56 to their positions in the standby of the printing system 1. Specifically, the printing apparatus controller 25 sets the maintainer 64 at the deployment position and sets the print bar 56 at the standby height position.

More specifically, in the state of printing illustrated in FIG. 15E, the printing apparatus controller 25 first controls the base motors 62F and 62R to set the print bar bases 60F and 60R to the retreat state as illustrated in FIG. 15D.

Then, the printing apparatus controller 25 controls the lifting-lowering motor 59 to lift the print bar 56 to a predetermined height above the standby height position as illustrated in FIG. 15C.

Next, the printing apparatus controller 25 controls the movement motor 65 to move the maintainer 64 from the retreat position to the deployment position.

Then, the printing apparatus controller 25 controls the base motors 62F and 62R to switch the print bar bases 60F and 60R from the retreat state to the deployment state as illustrated in FIG. 15B.

Then, the printing apparatus controller 25 controls the lifting-lowering motor 59 to lower the print bar 56 to the standby height position as illustrated in FIG. 15A. The series of operations is thereby completed.

Next, operations performed when the maintenance of the inkjet head 66 is performed in the inkjet printing apparatus 3 are described.

In the inkjet printing apparatus 3, the maintenance of the inkjet head 66 is sometimes performed after the printing operation. When the maintenance of the inkjet head 66 is to be performed after the printing operation, the printing apparatus controller 25 replaces the maintainer 64 and the print bar 56 to the positions in the standby of the printing system 1 as described above. Specifically, the printing apparatus controller 25 sets the maintainer 64 and the print bar 56 in the printing state illustrated in FIG. 15E, to the standby state illustrated in FIG. 15A.

Then, the printing apparatus controller 25 performs the purging by forcedly discharging the ink from the nozzles of the head modules 76 and causing the ink to attach to the nozzle surfaces 76*a*. The ink not attaching to the nozzle surfaces 76*a* is received by the maintenance pan 91.

Next, the printing apparatus controller 25 controls the movement motor 65 to move the maintainer 64 from the deployment position to the retreat position.

In this case, since the print bar 56 is at the standby height position (maintenance position, position illustrated in FIG. 15A), the upper ends of the wipers 92 are located above the nozzle surfaces 76*a* as described above. Accordingly, the wipers 92 come into contact with the head modules 76 when the maintainer 64 moves from the deployment position to the retreat position. When the wipers 92 come into contact with the head modules 76, the wipers 92 are pressed against the head modules 76 and elastically deform. Then, the upper end portions of the wipers 92 slide on (wipe) the nozzle surfaces 76*a* with the movement of the maintainer 64.

Dust and the like on the nozzle surfaces 76*a* are thereby removed together with the ink attaching to nozzle surfaces 76*a* and the nozzle surfaces 76*a* are thus cleaned. The ink and the like removed from the nozzle surfaces 76*a* by the wipers 92 flow into the maintenance pan 91.

After the maintainer 64 moves while wiping the nozzle surfaces 76*a* and reaches the retreat position, the printing apparatus controller 25 replaces the maintainer 64 to the deployment position.

Specifically, the printing apparatus controller 25 controls the lifting-lowering motor 59 to lift the print bar 56 to a predetermined height above the standby height position. The print bar 56 is thereby set to the state where the nozzle surfaces 76*a* are located above the upper ends of the wipers 92.

Then, the printing apparatus controller 25 controls the movement motor 65 to move the maintainer 64 from the retreat position to the deployment position.

Next, the printing apparatus controller 25 controls the lifting-lowering motor 59 to lower the print bar 56 to the standby height position. The operations in the maintenance of the inkjet head 66 are thereby completed.

As described above, in the inkjet printing apparatus 3, the print bar unit 52 is movable to and from the print position, the pulled-out position, and the pushed-in position. The print bar unit 52 can be thereby moved to the position on the near side the print position and to the position on the far side of the print position as viewed from the user or the like. Setting the print bar unit 52 to the pulled-out position on the near side of the print position allows the user or the like to easily perform operations such as replacement of the inkjet head 66. Moreover, setting the print bar unit 52 to the pushed-in position on the far side of the print position allows the user or the like to access the conveyance route of the web W through the space on the near side of the print bar unit 52 and perform the work of laying the web W along the conveyance route. In other words, since the user or the like can access the conveyance route, which is under the print bar unit 52 when the print bar unit 52 is at the print position, without removing the print bar unit 52, operability of laying the web W is improved for the user or the like. The inkjet printing apparatus 3 can thus achieve excellent operability in the print bar unit 52 and its periphery.

Moreover, the pushed-in position of the print bar unit 52 is the position where the one-side portion of the conveyance route of the web W in the width direction, which is under the print bar unit when the print bar unit is at the first position, is exposed, while the opposite-side (remaining) portion (unexposed portion) of the conveyance route of the web W in the width direction is covered with a portion of the print bar unit 52 in the up-down direction. This can suppress the amount by which the print bar unit 52 protrudes from the conveyance route of the web W toward the far side (rear side) when the print bar unit 52 is set at the pushed-in position. Hence the depth dimension of the housing 21 can be suppressed. As a result, it is possible to suppress a size increase of the apparatus while securing the operability in the laying of the web W.

Furthermore, in the inkjet printing apparatus 3, since the print bar unit 52 has the maintainer 64, the apparatus configuration can be made more compact than in the case where the maintainer is provided outside the print bar unit 52. Hence, the size increase of the apparatus can be suppressed.

Moreover, in the inkjet printing apparatus 3, the wipers 92 of the maintainer 64 are fixed to the maintenance pan 91. Then, in the maintenance of the inkjet head 66, the printing apparatus controller 25 sets the print bar 56 to the standby height position (maintenance position) and moves the maintainer 64 set at the deployment position to the retreat position to cause the wipers 92 to wipe the nozzle surfaces 76*a* of the inkjet head 66. In this configuration, a mechanism and a drive source for moving the wipers in the maintainer can be thereby omitted. Accordingly, the size increase of the apparatus can be suppressed.

Furthermore, in the inkjet printing apparatus 3, the print bar unit 52 has the print bar bases 60F and 60R which can be switched between the deployment state and the retreat state. The printing apparatus controller 25 sets the print bar bases 60F and 60R to the retreat state in the lifting and lowering operations of the print bar 56 and sets the print bar bases 60F and 60R to the deployment state in positioning of the print bar 56 in the standby and the maintenance of the inkjet head 66. The print bar bases 60F and 60R thereby does not hinder the lifting and lowering operations of the print bar 56 and also allows the print bar 56 to be positioned in the standby and the maintenance of the inkjet head 66.

Moreover, in the inkjet printing apparatus 3, the print bar bases 60F and 60R in the deployment state form part of the flow path of the cooling air supplied to the inkjet head 66 in the printing by the print bar. The print bar bases 60F and 60R also function as part of the flow path of the cooling air as described above, and this can further suppress the size increase of the apparatus.

Note that, in the aforementioned embodiment, description is given of the configuration in which the user or the like manually moves the print bar unit 52 to and from the print position, the pulled-out position, and the pushed-in position. However, the configuration may be such that the print bar unit 52 is moved by drive force of a motor or the like.

Moreover, in the aforementioned embodiment, description is given of the configuration in which the unwinder 2 and the winder 4 are connected to the inkjet printing apparatus 3 as separate apparatuses. However, the configuration may be such that an unwinding unit which performs the same functions as the unwinder 2 and a winding unit which performs the same functions as the winder 4 are incorporated in the inkjet printing apparatus 3. Moreover, apparatuses such as a cutter which cuts the web W may be connected to the inkjet printing apparatus 3 as an external apparatuses.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing apparatus comprising:

a print bar unit movable in a first direction intersecting a conveyance direction of a print medium, the print bar unit including:

a print bar being liftable and lowerable in a second direction intersecting the conveyance direction and the first direction and having an inkjet head configured to eject an ink to the print medium being conveyed, a maintainer having an ink receiver configured to receive the ink from the inkjet head and a wiper fixed to the ink receiver, and a movement driver configured to move the maintainer between a deployment position and a retreat position, the deployment position being a position under the inkjet head in maintenance of the inkjet head in the second direction, the retreat position being a position where the maintainer is retreated from the deployment position in the first direction; and a controller configured to control the print bar unit, wherein, upon maintenance of the inkjet head, the controller is configured to drive the movement driver to move the maintainer from the deployment position to the retreat position with the print bar arranged at a maintenance position above a height position for printing in the second direction while wiping a nozzle surface of the inkjet head with the wiper of the maintainer being moved in the first direction.

2. The inkjet printing apparatus according to claim 1, wherein the print bar unit further includes a print bar positioner, a state of the print bar positioner being switchable between a deployment state in which the print bar positioner exists at least partially on a lifting-lowering trajectory of the print bar and a retreat state in which the print bar positioner is retreated from the lifting-lowering trajectory of the print bar, and the controller is configured to control the print bar unit such that the print bar positioner is in the retreat state upon the print bar being lifted and lowered between the maintenance position and the height position for printing and such that the print bar positioner is in the deployment state upon the print bar being arranged at the maintenance position and upon the print bar being arranged at the height position for printing, and the print bar positioner in the deployment state with the print bar arranged at the maintenance position supports the print bar and positions a height position of the print bar.

3. The inkjet printing apparatus according to claim 2, wherein the print bar positioner in the deployment state with the print bar arranged at the height position for printing forms a part of a flow path for cooling air supplied to the ink jet head.

4. The inkjet printing apparatus according to claim 2, wherein the print bar positioner includes a first print bar base and a second print bar base, the first print bar base and the second print bar base each include a supporting surface and a contact surface, and during the deployment state the supporting surface is in a horizontal state to support the print bar in a standby mode of the inkjet printing apparatus and during the maintenance of the inkjet head.

5. The inkjet printing apparatus according to claim 2, wherein the print bar positioner includes a first print bar base and a second print bar base, the first print bar base and the second print bar base each include a supporting surface and a contact surface, and during the retreat state the contact surface is in a vertical state to allow a lifting and lowering of the print bar in the second direction.

6. The inkjet printing apparatus according to claim 2, wherein the print bar positioner includes a first print bar base and a second print bar base, and the first print bar is rotatable in a counterclockwise direction and the second print bar is rotatable in a clockwise direction.

7. The inkjet printing apparatus according to claim 1, wherein the ink receiver is a tray having a recess for receiving the ink, and the wiper is disposed at a front end portion of the tray and projects upward from the tray to wipe from the inkjet head.

* * * * *